US010576774B2

(12) United States Patent
Fukumoto et al.

(10) Patent No.: US 10,576,774 B2
(45) Date of Patent: Mar. 3, 2020

(54) BALLPOINT PEN

(71) Applicant: MITSUBISHI PENCIL COMPANY, LIMITED, Tokyo (JP)

(72) Inventors: Takeo Fukumoto, Yokohama (JP); Tooru Nakajima, Yokohama (JP); Kazuhiko Furukawa, Yokohama (JP); Yusuke Kobayashi, Yokohama (JP); Tomoyuki Akagi, Yokohama (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/774,038

(22) PCT Filed: Nov. 9, 2016

(86) PCT No.: PCT/JP2016/083238
§ 371 (c)(1),
(2) Date: May 7, 2018

(87) PCT Pub. No.: WO2017/082297
PCT Pub. Date: May 18, 2017

(65) Prior Publication Data

US 2018/0319200 A1 Nov. 8, 2018

(30) Foreign Application Priority Data

Nov. 9, 2015 (JP) ..... 2015-219386

(51) Int. Cl.
*B43K 7/10* (2006.01)
*B43K 24/16* (2006.01)
(Continued)

(52) U.S. Cl.
CPC ..... *B43K 7/10* (2013.01); *B43K 1/082* (2013.01); *B43K 24/00* (2013.01); *B43K 24/163* (2013.01); *B43K 25/022* (2013.01)

(58) Field of Classification Search
CPC ... B43K 7/10; B43K 7/00; B43K 1/08; B43K 1/082; B43K 24/00; B43K 23/022
See application file for complete search history.

(56) References Cited

U.S. PATENT DOCUMENTS 7,862,249 B2 * 1/2011 Ohashi ..... B43K 1/08 401/209
2015/0078803 A1 * 3/2015 Osano ..... B43K 7/08 401/215

(Continued)

FOREIGN PATENT DOCUMENTS

CN 1651262 A 8/2005
CN 104640712 A 5/2015

(Continued)

OTHER PUBLICATIONS

WO2013183744MT, Takeo Fukunnoto, Dec. 2013, machine translation of WO2013183744.*

(Continued)

*Primary Examiner* — Paul R Durand
*Assistant Examiner* — Randall A Gruby
(74) *Attorney, Agent, or Firm* — Westerman, Hattori, Daniels & Adrian, LLP

(57) ABSTRACT

A ballpoint pen is provided in which the width of the drawing line can be changed, wherein responsiveness can be improved when distinguishing between drawing thin lines and thick lines. A ballpoint pen 1 provided at the pen tip side with a first writing part having a writing ball 25, wherein the ballpoint pen 1 is characterized by being provided with a writing part at the pen tip side with which it is possible to write a thicker line than the line written with the first writing part, only the first writing part being used when the writing weight is 1 g and the writing angle is 90°, and the second (Continued)

writing part being used when the writing weight is 200 g, and the writing angle is 40-90°.

7 Claims, 20 Drawing Sheets

(51) Int. Cl.

| | |
|---|---|
| ***B43K 1/08*** | (2006.01) |
| ***B43K 24/00*** | (2006.01) |
| *B43K 25/02* | (2006.01) |

(56) References Cited

U.S. PATENT DOCUMENTS

| | | | | |
|---|---|---|---|---|
| 2015/0165812 | A1 | 6/2015 | Fukumoto et al. | |
| 2017/0001464 | A1 | 1/2017 | Fukumoto | |
| 2018/0370274 | A1* | 12/2018 | Nakajima ..... | B43K 3/00 |

FOREIGN PATENT DOCUMENTS

| | | | |
|---|---|---|---|
| DE | 1511403 | A1 | 6/1969 |
| EP | 2860045 | A1 | 4/2015 |
| JP | 49-105230 | U | 9/1974 |
| JP | 56-69481 | U | 6/1981 |
| JP | 56-83075 | U | 7/1981 |
| JP | 2004-1246 | A | 1/2004 |
| JP | 2013-252654 | A | 12/2013 |
| JP | 2013-252655 | A | 12/2013 |
| WO | 2008/097799 | A1 | 8/2008 |
| WO | WO2013183744 | * | 12/2013 |
| WO | 2015/087852 | A1 | 6/2015 |

OTHER PUBLICATIONS

Extended (supplementary) European Search Report dated May 16, 2019, issued in counterpart EP Application No. 16864258.5. (8 pages).

Office Action dated Jun. 5, 2019, issued in counterpart CN application No. 201680065517.6, with English translation. (11 pages).

* cited by examiner

FIG. 4( a )
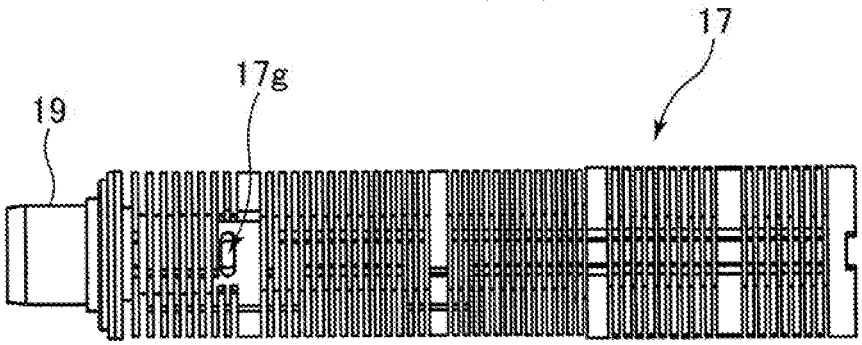
FIG. 4( b )
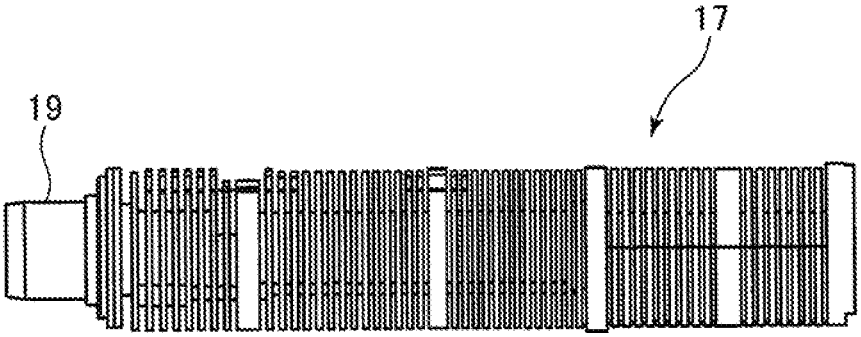
FIG. 4( c )
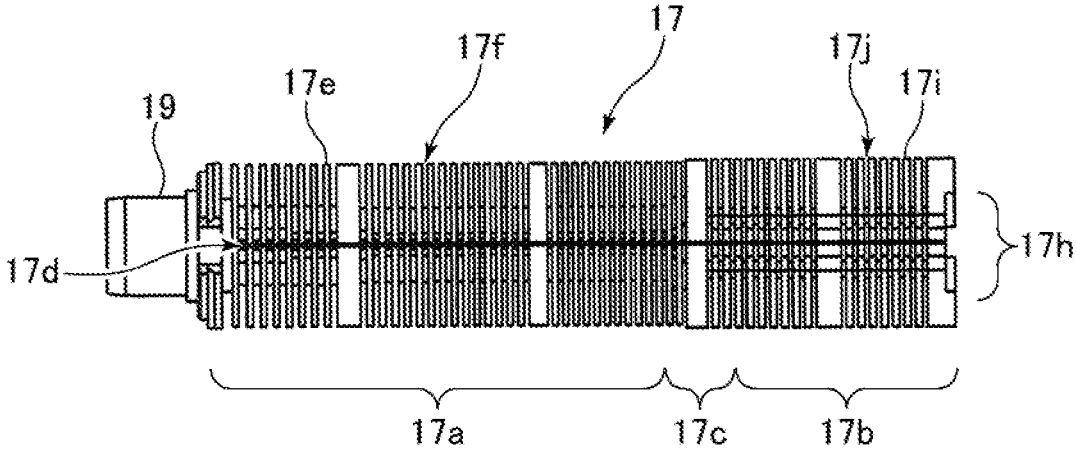

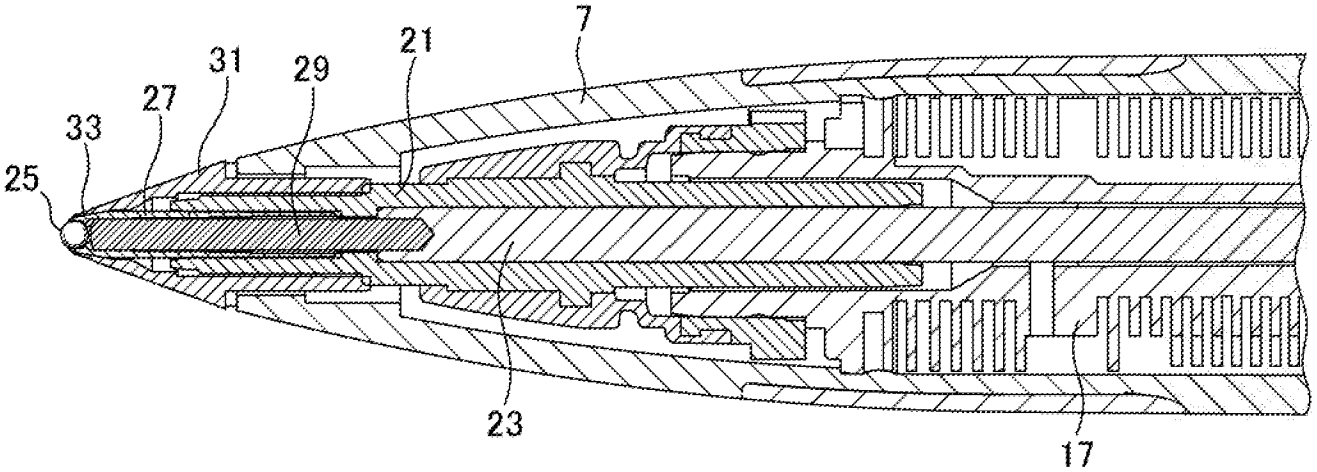
FIG. 5( a )
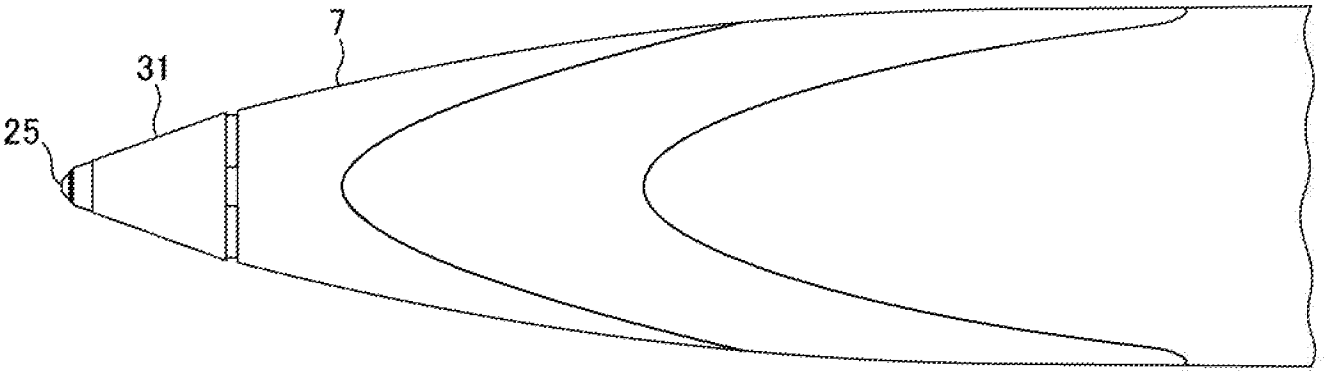
FIG. 5( b )

FIG. 6( a )
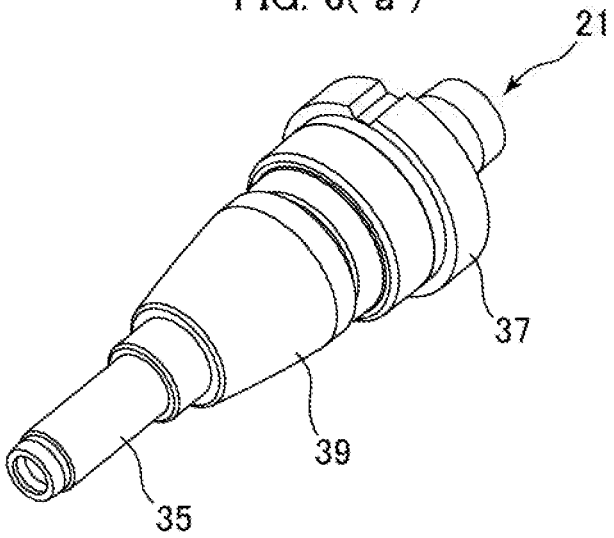
FIG. 6( b )
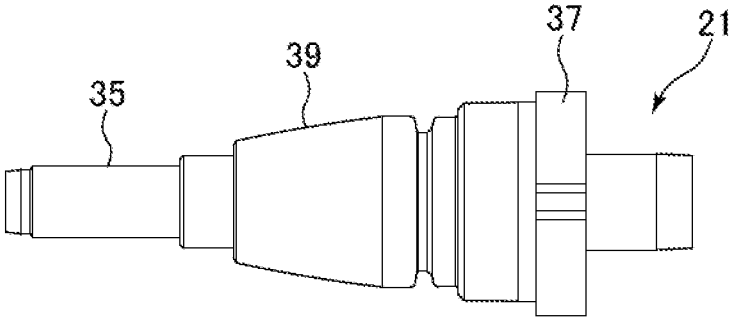
FIG. 6( c )
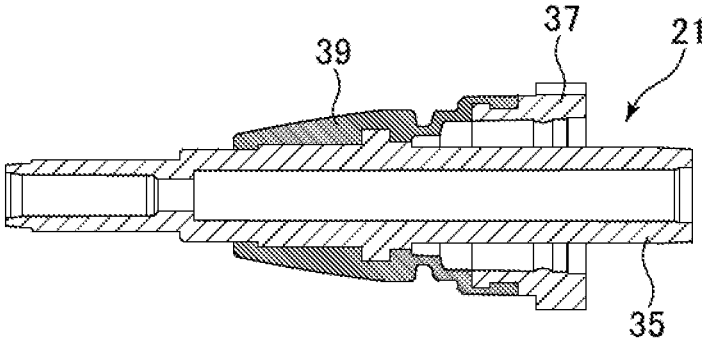

FIG. 7( a )
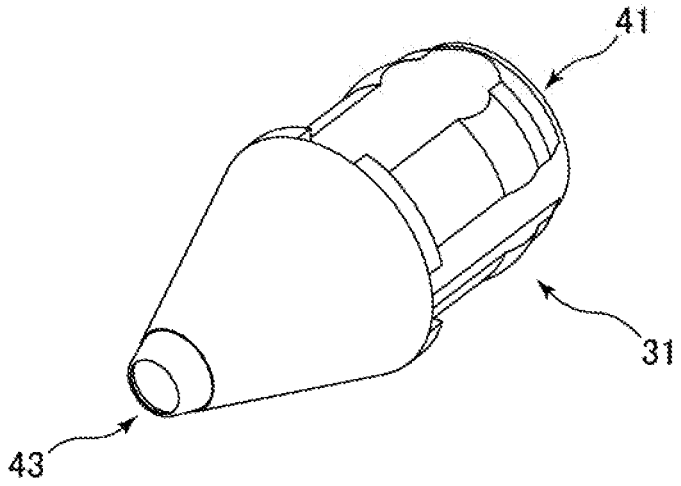
FIG. 7( b )
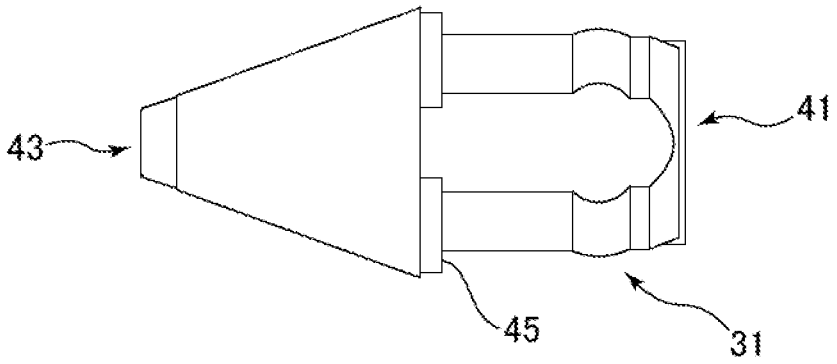
FIG. 7( c )
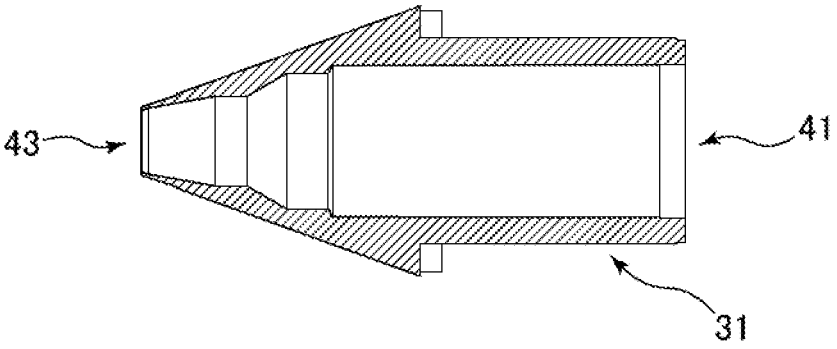

FIG. 8( a )
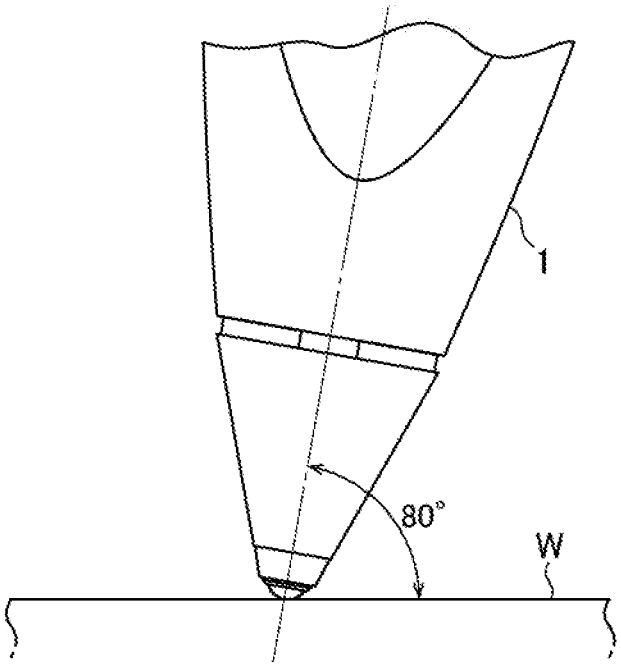
FIG. 8( b )
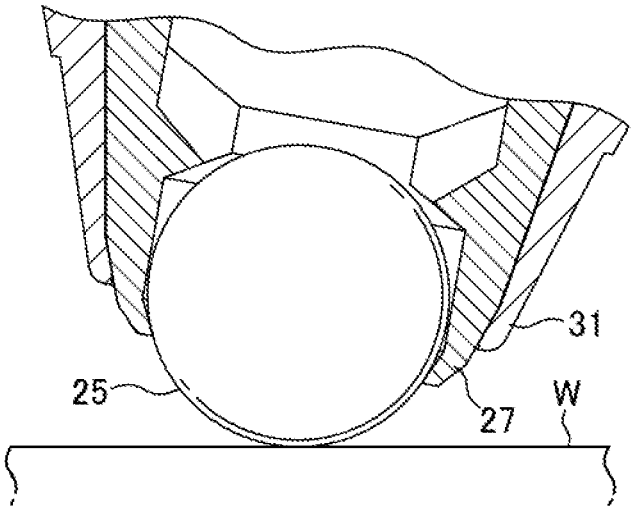

FIG. 9( a )
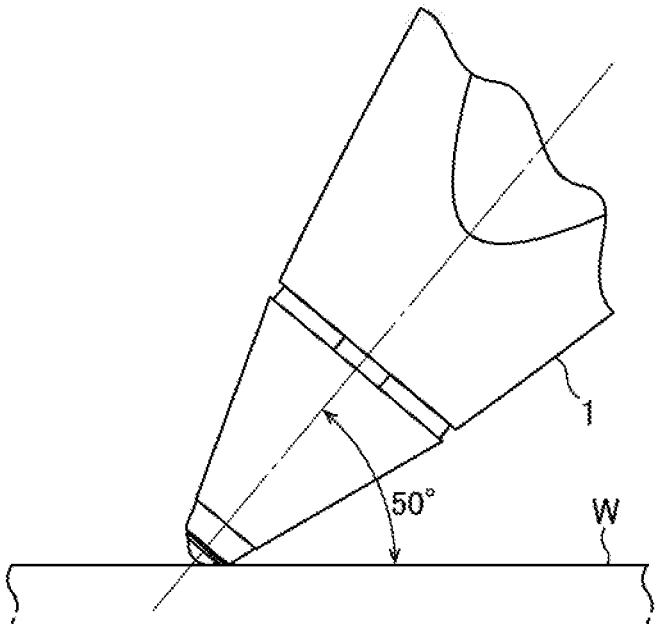
FIG. 9( b )
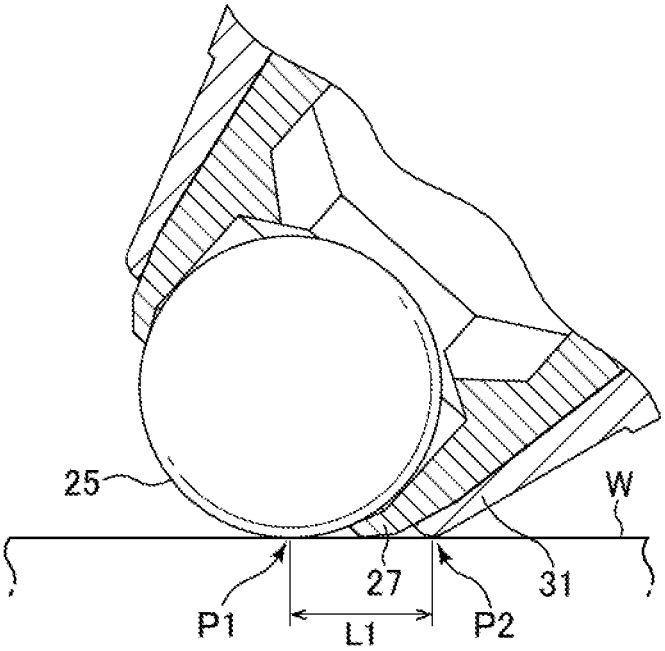

FIG. 11( a )
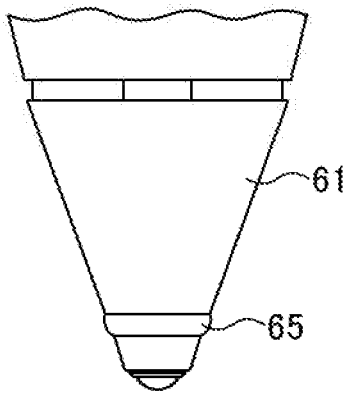
FIG. 11( b )
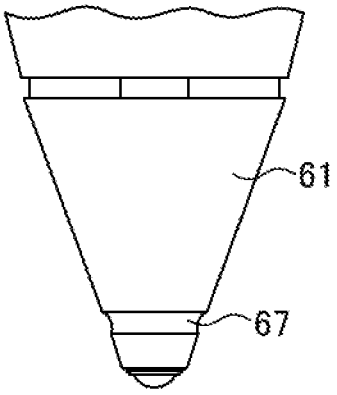
FIG. 11( c )
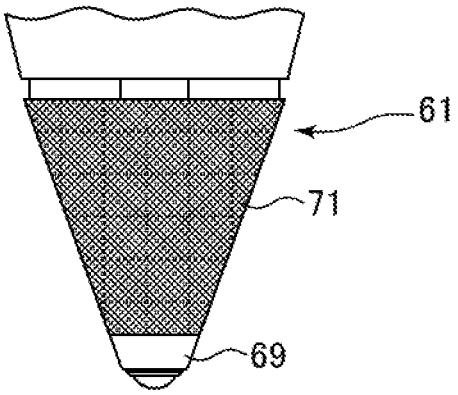

FIG. 12( a )
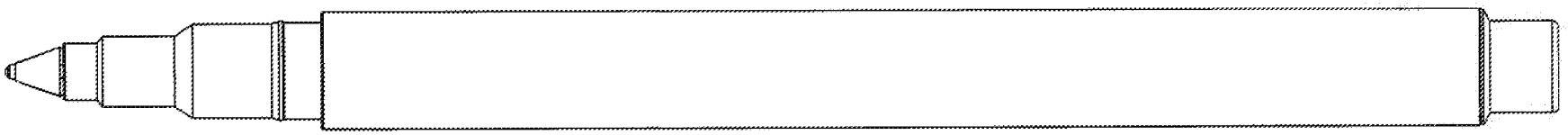
FIG. 12( b )
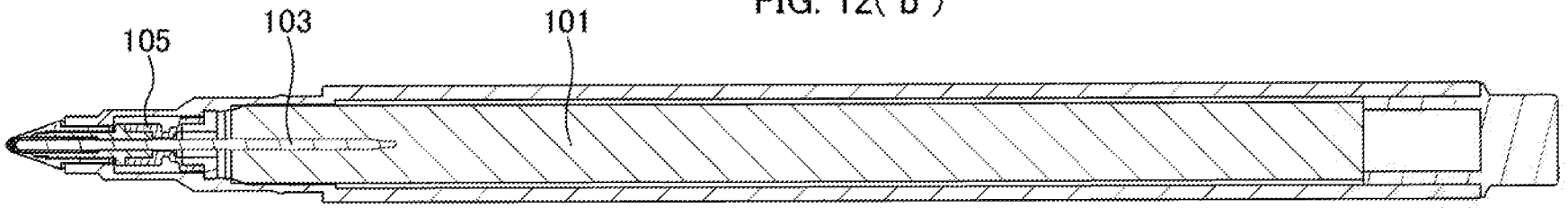

FIG.13( a )
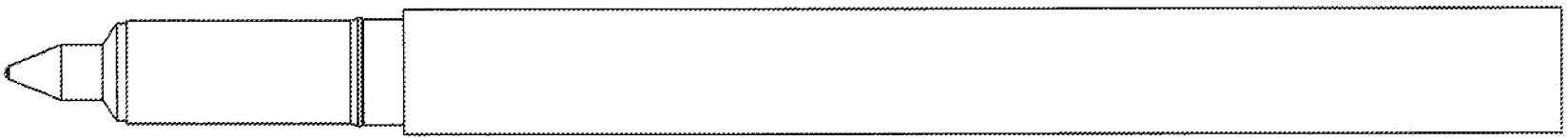
FIG.13( b )
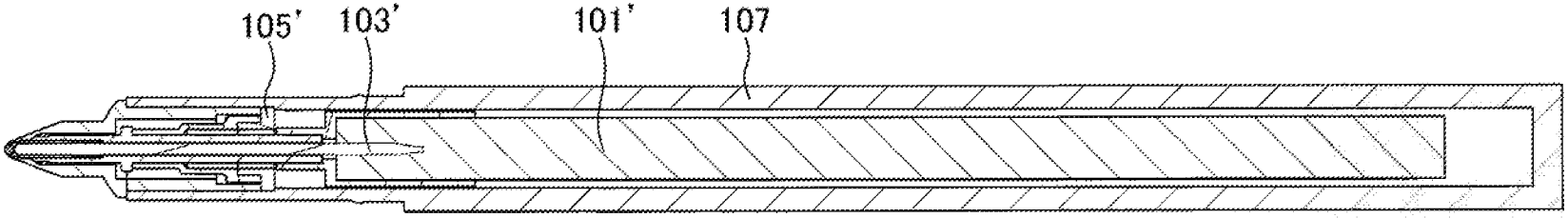

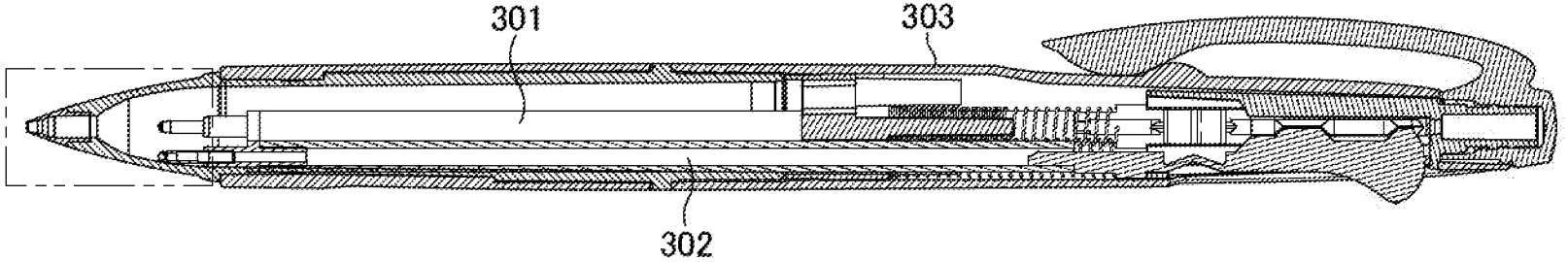
FIG.16( a )
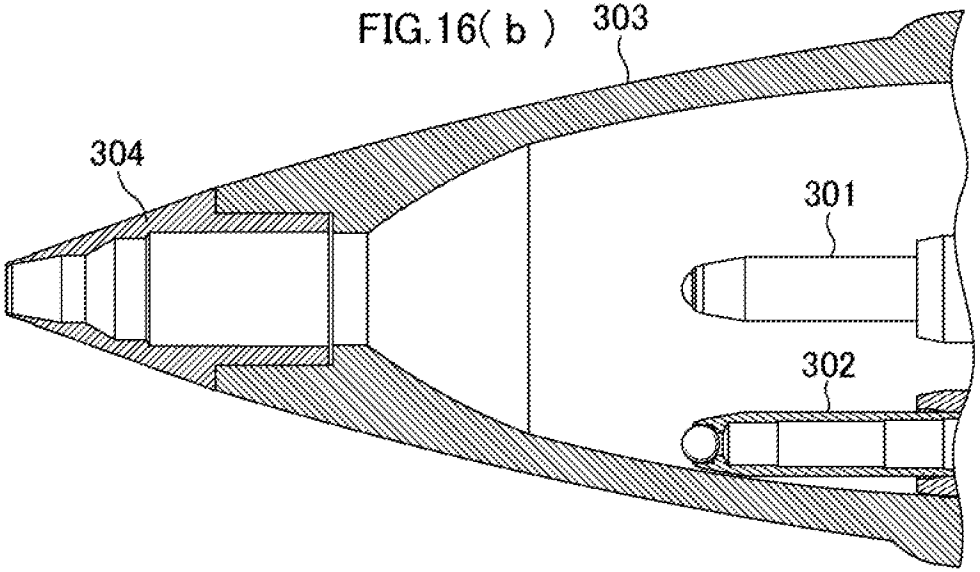
FIG.16( b )

FIG.17 ( a )
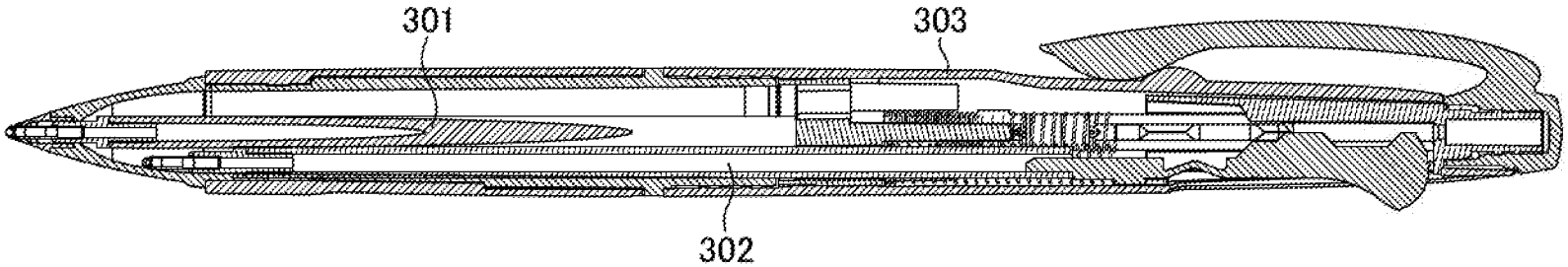
FIG.17 ( b )
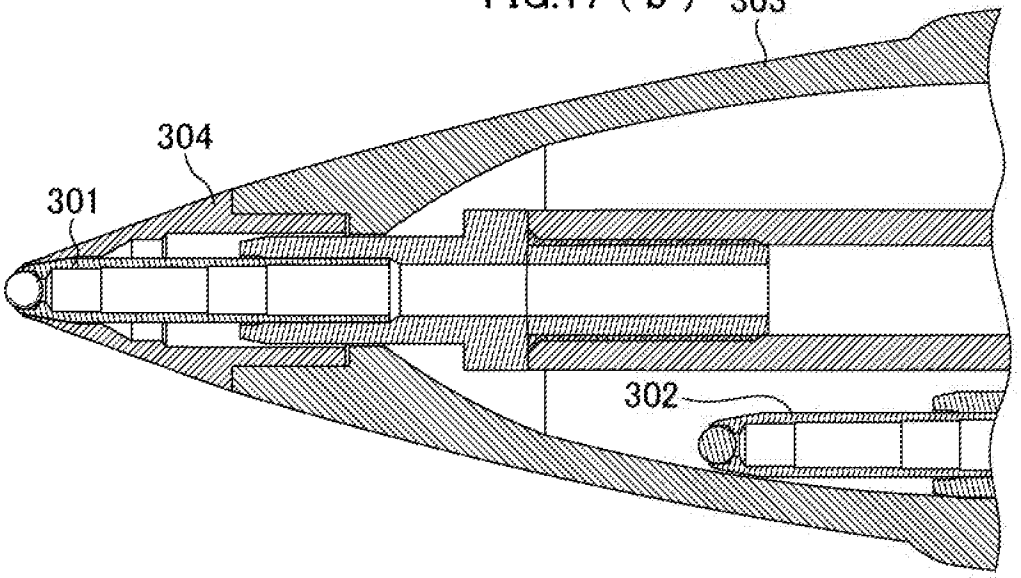

FIG.18 ( a )
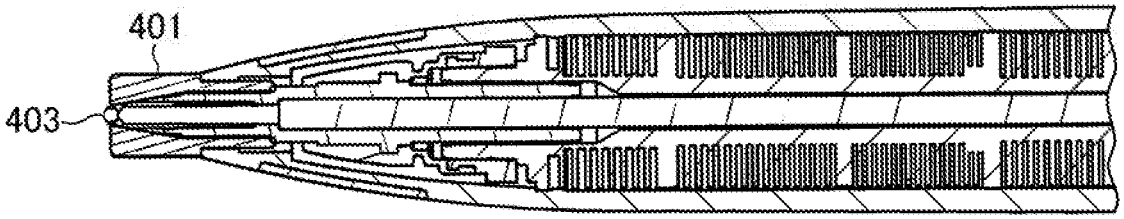
FIG.18( b )
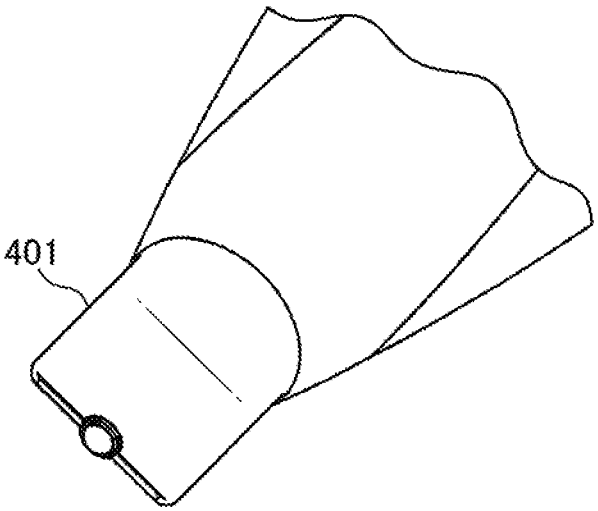

FIG.19( a )
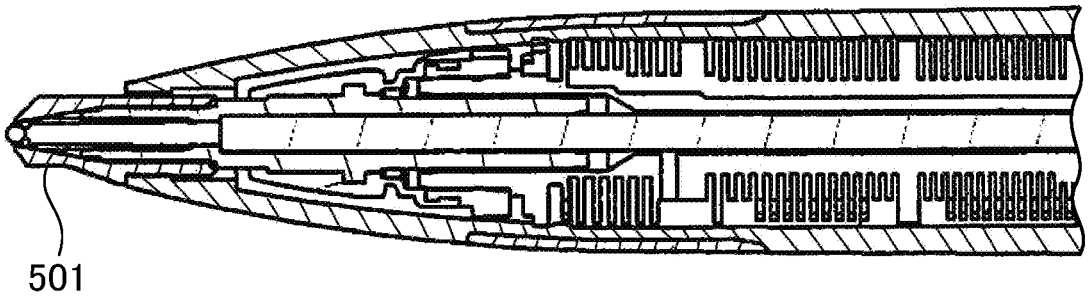
FIG.19( b )
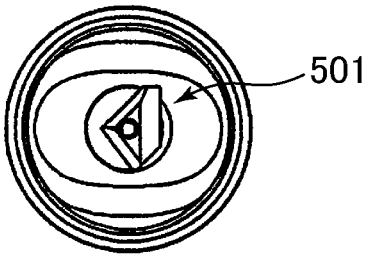

FIG. 20( a )
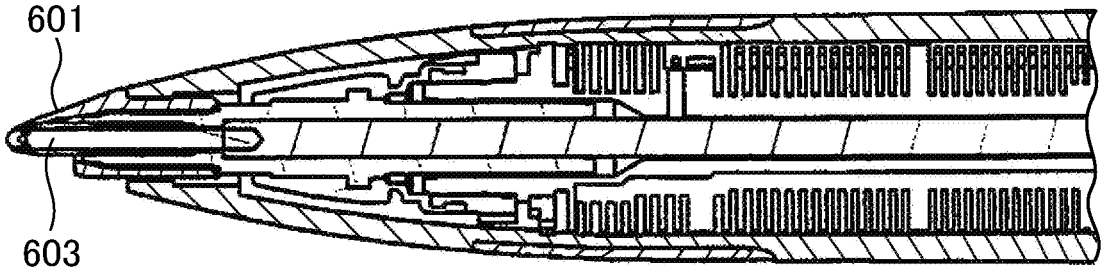
FIG. 20( b )
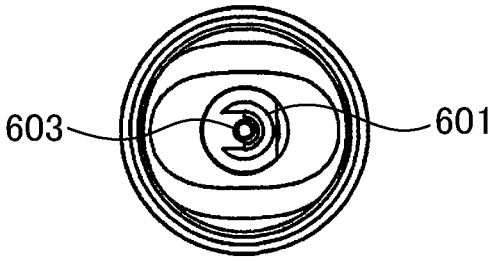
FIG. 20( c )
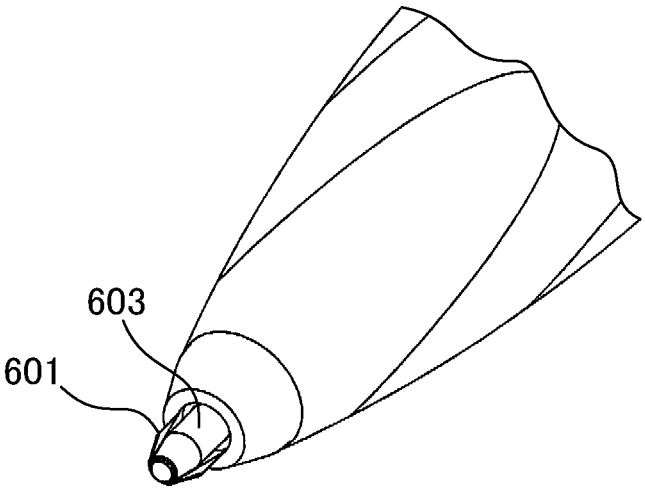

FIG. 21( a )
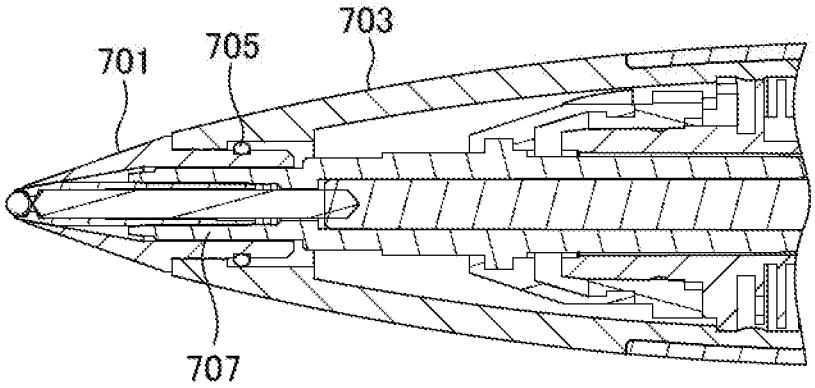
FIG. 21( b )
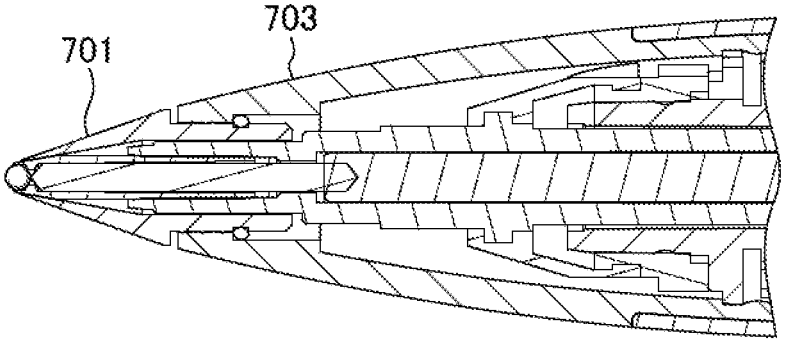

BALLPOINT PEN

TECHNICAL FIELD

The present invention relates to a ballpoint pen, and particularly relates to a ballpoint pen which is capable of changing a width of a drawn line.

BACKGROUND ART

Conventionally, a ballpoint pen which is capable of changing a width of a drawn line is known (for instance, Patent Literature 1).

CITATION LIST

Patent Literature

Patent Literature 1: Japanese Patent Laid-Open No. 2013-252654

Patent Literature 2: Japanese Patent Laid-Open No. 2013-252655

SUMMARY OF INVENTION

Technical Problem

In a ballpoint pen described in Patent Literatures 1 and 2, an outer member is provided on a circumference of a holder for holding a writing ball. In addition, such a ballpoint pen having the outer member can draw a thin line when being used at such an angle that the outer member is not brought into contact with the surface of paper, and can draw a thick line when being used at such an angle that the outer member is brought into contact with the surface of the paper.

However, in the ballpoint pen described in Patent Literatures 1 and 2, it becomes possible to draw a thin line and a thick line respectively, but there has been a problem that responsiveness is insufficient at the time when a user changes the thickness of the line, depending on use conditions of the user.

Then, the present invention has been made to solve the above described problems, and is directed at providing a ballpoint pen that can improve the responsiveness at the time of changing between thin line drawing and thick line drawing, in a ballpoint pen which is capable of changing the width of the drawn line.

Solution to Problem

In order to solve the above described problems, a ballpoint pen in the present invention comprises a first writing part having a writing ball on a pen tip side, and a second writing part on the pen tip side, which is capable of drawing a thicker line than a line drawn by the first writing part, wherein only the first writing part works when a writing weight is 1 g and a writing angle is 90 degrees, and wherein the second writing part works when the writing weight is 200 g and the writing angle is 40 to less than 90 degrees.

Incidentally, in the present application, a term "writing weight" means a load relating to the writing part at the time of writing, which can be measured with the use of a commercially available load cell, a force gauge or a platform scale, through a writing surface such as a paper surface.

According to the thus configured present invention, in the case where the writing weight is 1 g and the writing angle is 90 degrees, in other words, in the case where lines are drawn by a raised writing instrument and with a lowered writing pressure, only the first writing part works, and thereby a comparatively thin line can be drawn. On the other hand, in the case where the writing weight is 200 g and the writing angle is 40 to less than 90 degrees, in other words, in the case where the lines are drawn by a tilted writing instrument with an increased writing pressure, the second writing part works, and thereby a comparatively thick line can be drawn. In addition, the writing weight can be easily adjusted by the writing pressure of the user, and the writing angle can be easily adjusted by the angle of the hand of the user. Accordingly, according to the present invention, the user can easily draw a thin line and a thick line respectively by adjusting the writing pressure and the angle of the hand.

Advantageous Effect of Invention

In a ballpoint pen which is capable of changing the width of the drawn line, the responsiveness at the time of changing between thin line drawing and thick line drawing can be improved.

BRIEF DESCRIPTION OF DRAWINGS

FIGS. 4(*a*) to 4(*c*) are views showing a collector of the ballpoint pen of the present invention.

FIGS. 5(*a*) and 5(*b*) are enlarged views of the vicinity of a front end portion of the ballpoint pen according to the embodiment of the present invention; and more specifically, FIG. 5(*a*) is a cross-sectional view of a main part in the vicinity of the front end portion of the ballpoint pen, and FIG. 5(*b*) is a side view of the vicinity of the front end portion of the ballpoint pen.

FIGS. 6(*a*) to 6(*c*) are views showing a joint of the ballpoint pen according to the embodiment of the present invention.

FIGS. 7(*a*) to 7(*c*) are views showing an outer member of the ballpoint pen according to the embodiment of the present invention.

FIGS. 8(*a*) and 8(*b*) are views showing a state in which the ballpoint pen according to the embodiment of the present invention is used.

FIGS. 9(*a*) and 9(*b*) are views showing a state in which the ballpoint pen according to the embodiment of the present invention is used.

FIGS. 11(*a*) to 11(*c*) are side views showing a modified example of the outer member of the ballpoint pen according to the embodiment of the present invention.

FIGS. 12(*a*) and 12(*b*) are a side view and a cross-sectional view of the ballpoint pen according to the modified example.

FIGS. 13(*a*) and 13(*b*) are a side view and a cross-sectional view of a ballpoint pen according to a further modified example.

FIGS. 16(*a*) and 16(*b*) are cross-sectional views of a ballpoint pen according to a further modified example.

FIGS. 17(*a*) and 17(*b*) are cross-sectional views of the ballpoint pen according to the further modified example.

FIGS. 18(*a*) and 18(*b*) are cross-sectional views of a ballpoint pen according to a further modified example.

FIGS. 19(*a*) and 19(*b*) are a cross-sectional view and a front view of a ballpoint pen according to a further modified example.

FIGS. 20(*a*) to 20(*c*) are a cross-sectional view, a front view and a perspective view of a ballpoint pen according to a further modified example.

FIGS. 21(*a*) and 21(*b*) are cross-sectional views of a ballpoint pen according to a further modified example.

DESCRIPTION OF EMBODIMENT

A ballpoint pen according to an embodiment of the present invention will be described below with reference to the drawings. Incidentally, in the present specification, the term "front part" of the ballpoint pen and its components means a side on which the writing ball is provided in the axial direction of the ballpoint pen, and the term "rear part" means the opposite side to the front side.

Figure 1:
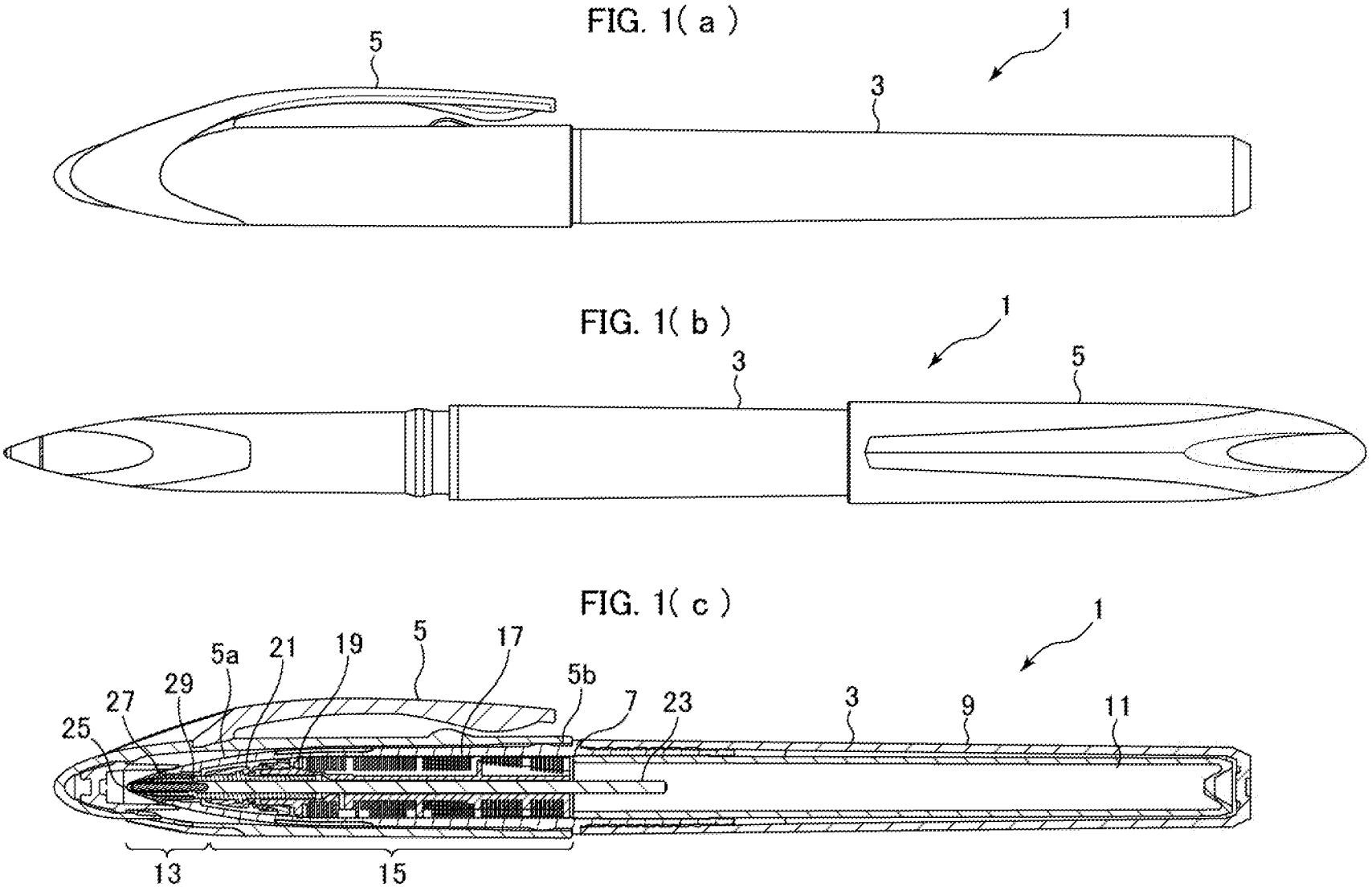
FIGS. 1(*a*) to 1(*c*) show ballpoint pens according to an embodiment of the present invention; and more specifically, FIG. 1(*a*) shows a state in which the front part of the ballpoint pen is covered with a cap, FIG. 1(*b*) shows a state in which the cap is detached from the front part of the ballpoint pen and is attached to the rear part thereof, and FIG. 1(*c*) shows a cross-sectional view of the state of FIG. 1(*a*).
Figure 2:
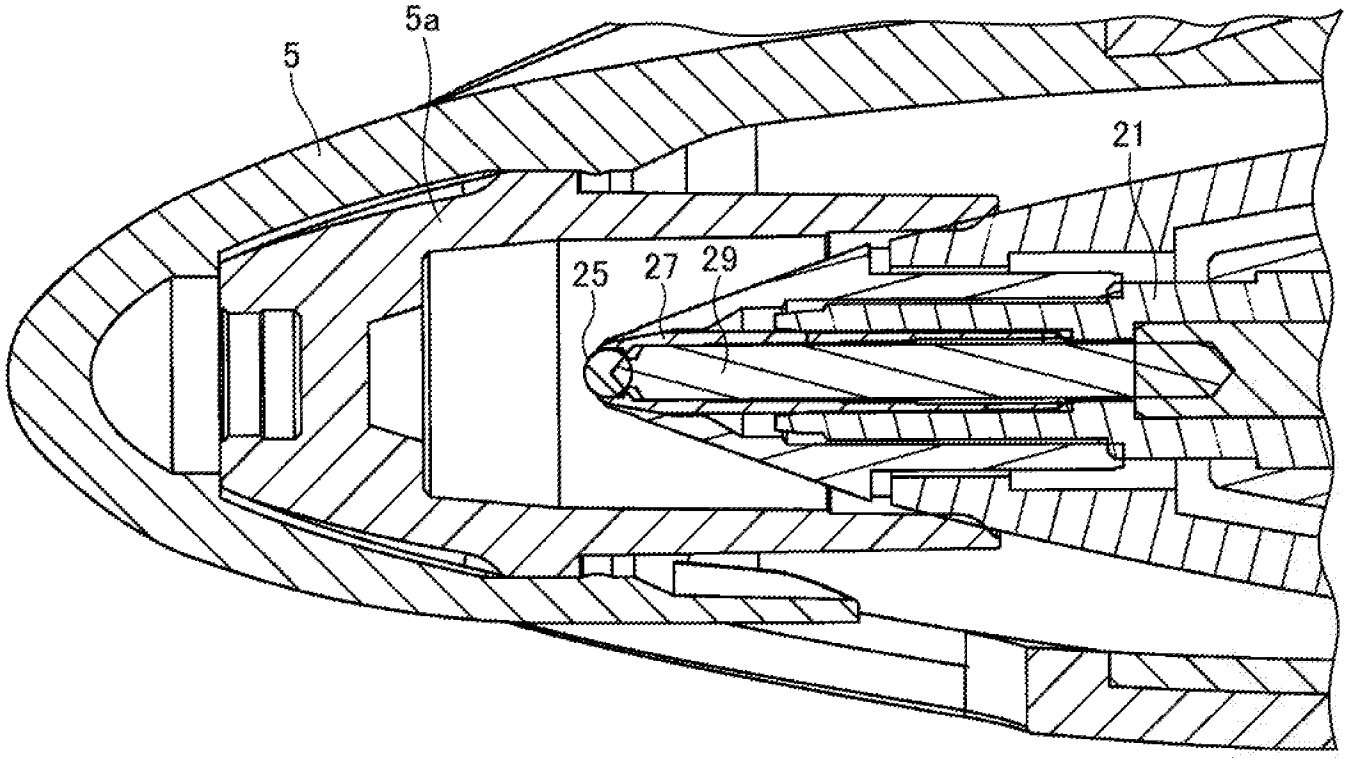
FIG. 2 is an enlarged view of a main part of FIG. 1(*c*).

FIGS. 1(*a*) to 1(*c*) show ballpoint pens according to an embodiment of the present invention, and more specifically; FIG. 1(*a*) shows a state in which the front part of the ballpoint pen is covered with a cap, FIG. 1(*b*) shows a state in which the cap is detached from the front part of the ballpoint pen and is attached to the rear part thereof, and FIG. 1(*c*) shows a cross-sectional view of the state of FIG. 1(*a*); and FIG. 2 shows an enlarged view of a main part of FIG. 1(*c*). In addition, FIG. 3 shows an exploded perspective view of the ballpoint pen.

Figure 3:
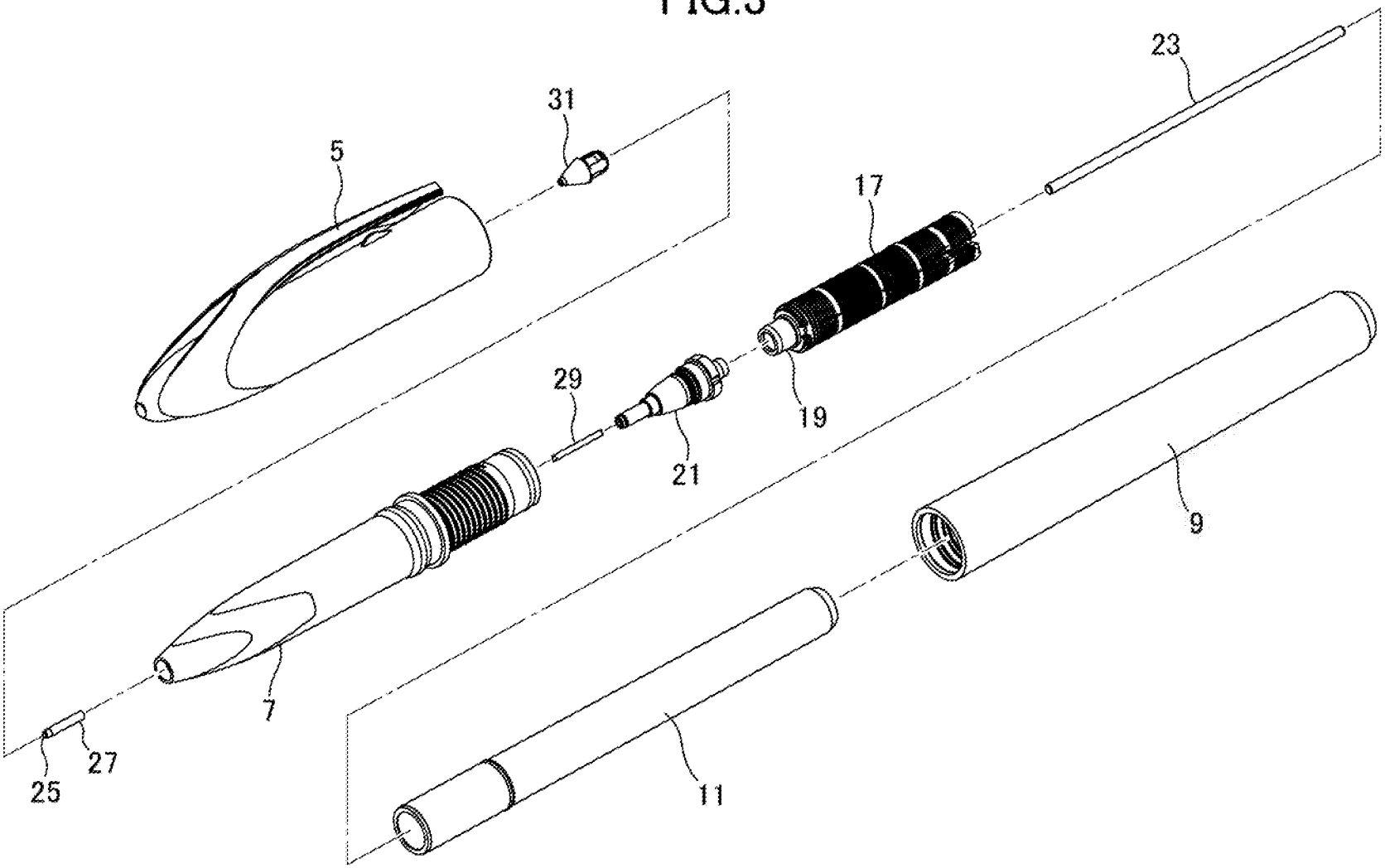
FIG. 3 is an exploded perspective view of the ballpoint pen according to an embodiment of the present invention.

As is shown in FIG. 1(*a*) to FIG. 3, a ballpoint pen 1 has a main body 3 of the ballpoint pen and a cap 5 which is attached to the main body 3.

The main body 3 of the ballpoint pen has a generally tubular shape so that a user can grasp at the time of use, and has a front side shaft tube 7 and a rear side shaft tube 9. Threads are provided on the rear end portion of the front side shaft tube 7 and the front end portion of the rear side shaft tube 9, respectively, and by both of the threads being engaged with each other, the front side shaft tube 7 and the rear side shaft tube 9 are fixed to each other. In addition, by the front side shaft tube 7 and the rear side shaft tube 9 which have been engaged with and fixed to each other, a space is formed inside which receives each component for writing with the ballpoint pen. In addition, a fixing method by press fitting may be used for fixing the front side shaft tube 7 and the rear side shaft tube 9, instead of threaded engagement. In this case, in order to prevent an outer member 31 from being damaged by the impact at the time of assembly, the press fitting force is desirably set at 300 N or smaller. Incidentally, in the following, the space formed in the inside of the front side shaft tube 7 and the rear side shaft tube 9 will be simply referred to as "internal space", for explanation in detail.

The cap 5 is structured so as to be capable of being attached to and detached from the front side of the main body 3 of the ballpoint pen, and seals the tip of the ballpoint pen thereby to prevent the ink from drying up. The cap 5 has an inner cap 5*a* and a fitting portion 5*b*. The inner cap 5*a* is structured so as to fit over the main body 3 so as to completely seal the outer member 31 and the writing ball 25 of the ballpoint pen, which will be described below. In addition, the cap 5 itself is detachably attached to the main body 3 with a predetermined fitting force, for instance, a fitting force of 60 N or smaller, through the fitting portion 5*b*. By the fitting force of the cap 5 being set at 60 N or smaller, the outer member 31 can be prevented from being damaged by the impact at the time when the cap 5 is attached.

In the rear side of the internal space, an ink storage part 11 for storing ink therein is arranged; in the front side of the internal space, a writing part 13 for writing with the ink in the ink storage part 11 is arranged; and further, an ink supply part 15 for supplying the ink in the ink storage part 11 to the writing part 13 is provided in between the ink storage part 11 and the writing part 13.

The ink storage part 11 stores a predetermined ink therein, and is structured so as to be capable of appropriately supplying the ink to the writing part 13 by a capillary force, when the amount of ink in the writing part 13 has become insufficient.

Any of pigments and dyes may be used as a coloring material, for the ink which is stored in the ink storage part 11. There is no particular restriction on the type of the pigment, and any arbitrary type can be used from inorganic and organic pigments which are conventionally used for writing instruments such as a water base ballpoint pen.

Examples of the inorganic pigments include carbon black and metal powder etc. In addition, examples of the organic pigments include azo lake, insoluble azo pigments, chelate azo pigments, phthalocyanine pigments, perylene and perinone pigments, anthraquinone pigments, quinacridone pigments, dye lake, nitro pigments and nitroso pigments. Specifically, usable examples include Phthalocyanine Blue (C. I. 74160), Phthalocyanine Green (C. I. 74260), Hansa Yellow 3G (C. I. 11670), Disazo Yellow GR (C. I. 21100), Permanent Red 4R (C. I. 12335), Brilliant Carmine 6B (C. I. 15850) and Quinacridone Red (C. I. 46500).

In addition, plastic pigments which are composed of particles of a styrenic or acrylic resin may also be used. Furthermore, hollow resin particles having voids inside the particles can be used as a white pigment, or a pigment that is also referred to as a pseudo pigment which is a resin particle dyed with dye can be also used. Specific product names of the pseudo pigments include Sinloihi color SF series (Sinloihi Co., Ltd.), and NKW and NKP series (Nippon Keiko Kagaku CO., Ltd.).

Any one of a direct dye, an acidic dye, an edible dye and a basic dye can be used as a water-soluble dyestuff. Examples of the direct dyes include: C. I. Direct Black 17, Direct Black 19, Direct Black 22, Direct Black 32, Direct Black 38, Direct Black 51 and Direct Black 71; C. I. Direct Yellow 4, Direct Yellow 26, Direct Yellow 44 and Direct Yellow 50; C. I. Direct Red 1, Direct Red 4, Direct Red 23, Direct Red 31, Direct Red 37, Direct Red 39, Direct Red 75, Direct Red 80, Direct Red 81, Direct Red 83, Direct Red 225, Direct Red 226 and Direct Red 227; and C. I. Direct Blue 1, Direct Blue 15, Direct Blue 71, Direct Blue 86, Direct Blue 106 and Direct Blue 119 and so on.

Examples of the acid dyes include: C. I. Acid Black 1, Acid Black 2, Acid Black 24, Acid Black 26, Acid Black 31, Acid Black 52, Acid Black 107, Acid Black 109, Acid Black 110, Acid Black 119 and Acid Black 154; C. I. Acid Yellow 7, Acid Yellow 17, Acid Yellow 19, Acid Yellow 23, Acid Yellow 25, Acid Yellow 29, Acid Yellow 38, Acid Yellow 42, Acid Yellow 49, Acid Yellow 61, Acid Yellow 72, Acid Yellow 78, Acid Yellow 110, Acid Yellow 127, Acid Yellow 135, Acid Yellow 141 and Acid Yellow 142; C. I. Acid Red 8, Acid Red 9, Acid Red 14, Acid Red 18, Acid Red 26, Acid Red 27, Acid Red 35, Acid Red 37, Acid Red 51, Acid Red 52, Acid Red 57, Acid Red 82, Acid Red 87, Acid Red 92, Acid Red 94, Acid Red 115, Acid Red 129, Acid Red 131, Acid Red 186, Acid Red 249, Acid Red 254, Acid Red 265 and Acid Red 276; C. I. Acid Violet 18 and Acid Violet 17; C. I. Acid Blue 1, Acid Blue 7, Acid Blue 9, Acid Blue 22, Acid Blue 23, Acid Blue 25, Acid Blue 40, Acid Blue 41, Acid Blue 43, Acid Blue 62, Acid Blue 78, Acid Blue 83, Acid Blue 90, Acid Blue 93, Acid Blue 103, Acid Blue 112, Acid Blue 113 and Acid Blue 158; and C. I. Acid Green 3, Acid Green 9, Acid Green 16, Acid Green 25 and Acid Green 27 and so on.

Most of edible dyes are included in the direct dye or the acidic dye, but one example of the dyes which are not included therein includes C. I. Food Yellow 3.

Examples of the basic dyes include: C. I. Basic Yellow 1, Basic Yellow 2 and Basic Yellow 21; C. I. Basic Orange 2, Basic Orange 14 and Basic Orange 32; C. I. Basic Red 1, Basic Red 2, Basic Red 9 and Basic Red 14; C. I. Basic Brown 12; and Basic Black 2 and Basic Black 8 and so on.

These coloring agents may be used each solely or in combination with one or more other coloring agents, and the content of the coloring agents in the ink is usually in a range of a weight ratio of 0.5 to 30%, and is preferably in a range of a weight ratio of 1 to 15%.

If the content of the coloring agent is less than 0.5%, the coloring power is insufficient, which is not preferable. On the other hand, when the content of the coloring agent exceeds 30%, a writing failure may occur, which is accordingly not preferable.

When the dyes are used, the ink which has adhered to the writing part 13 tends to remain thereon as stain, and accordingly it is preferable to use the pigments.

Furthermore, in order to prevent the writing failure due to drying and solidification of the ink at the pen tip, it is preferable to set the content of the water-soluble solvent in the ink, at a weight ratio of 5% to 25%. In this case, examples of water-soluble solvents include glycols such as ethylene glycol, diethylene glycol, triethylene glycol, propylene glycol, polyethylene glycol, 3-butylene glycol, thiodiethylene glycol and glycerin; ethylene glycol monomethyl ether and diethylene glycol monomethyl ether etc.; and can be used alone or by mixture.

In addition, it is preferable to blend at least one selected from among the trimethylolpropane, the trimethylol ethane and the neopentyl glycol which are water-soluble solvents other than the above described solvents, in the ink, in a weight ratio of 0.1 to 5% with respect to the ink.

Generally, if the amount of the water-soluble solvent to be blended increases, the permeability of the ink to paper decreases, and accordingly the drying speed of the drawn line becomes slow. However, trimethylolpropane, trimethylol ethane and neopentyl glycol have few such properties of lowering the permeability, and they do not easily cause lowering of the drying speed of the drawn line. On the other hand, the above substances have the properties of preventing the drying and the solidification at the pen tip, and accordingly a writing failure does not easily occur even when the pen tip is exposed for a long time.

The ink can be blended with saccharides. Examples of the saccharides specifically include monosaccharides, disaccharides, oligosaccharides, reducing saccharides, non-reducing saccharides, sugar alcohols, decomposed products of reduced starch, and mixtures thereof. It is preferable to use non-reducing saccharides out of the above saccharides, and is particularly preferable to use the sugar alcohols. Saccharides having reducing properties occasionally cause a discoloration of the ink or cause a fluctuation of the pH.

The non-reducing saccharides are not particularly limited as long as the non-reducing saccharides are saccharides which do not exhibit reducing properties, and examples of the non-reducing saccharides include sucrose, trehalose and sugar alcohols. Reducing saccharides such as glucose (grape sugar) are saccharides which exhibit weak reducing properties by having a carbonyl group (reducing group) such as an aldehyde group and a ketone group in the molecule; but on the other hand, the non-reducing saccharides to be used in the present embodiment do not exhibit the reducing properties because the group having reducing properties of the monosaccharide is bonded to another saccharide through a glycosidic bond or the like.

The sugar alcohol is a generic term of chain polyhydric alcohol obtained by the reduction (hydrogenation) of a carbonyl group which saccharides have. Examples of the sugar alcohols include "sorbitol" obtained by the reduction of glucose, "maltitol" obtained by the reduction of maltose, decomposed products of reduced starch (reduced starch syrup) which are obtained by the reduction of starch syrup and dextrin that have different degrees of saccharification, reduced dextrin, erythritol and pentaerythritol; and commercially available products can be used as the sugar alcohols.

It is desirable to use at least one type selected from sorbitol, erythritol, pentaerythritol, trehalose, and decomposed products of reduced starch, among the above non-reducing saccharides, from the viewpoint of further imparting temporal stability.

The saccharides work as a moisturizing agent in the ink, but on the other hand, have also such properties as to form a film and be solidified easily. In the present embodiment, if an ink remaining in the writing part 13 forms a film and is solidified, such a phenomenon occurs that the ink does not flow out (initial writing property is poor) when the next writing starts. In order to avoid such a problem, it is preferable that the saccharides contained in the ink have a degree of polymerization in between monosaccharide and 20 saccharide, and is further preferable that an average degree of polymerization is 3 to 10. Thereby, it is possible to prevent the film strength from becoming excessively strong, and it is possible to secure the initial writing property even in the case where the ink has remained in the writing part 13.

As a lubricant, a phosphoric acid ester can be blended with the ink. Specific examples thereof include: phosphoric acid monoesters of polyoxyethylene alkyl ethers or polyoxyethylene alkyl aryl ethers; phosphoric acid diesters and phosphoric acid triesters of polyoxyethylene alkyl ethers or polyoxyethylene alkyl aryl ethers; or derivatives thereof. These phosphoric acid esters may be used solely or in a mixed form with two or more types thereof.

The content of these phosphoric acid esters is preferably 0.05 to 5 wt %, and more preferably is 0.1 to 1 wt %, with respect to the total amount of the ink to be used. If the content of the phosphoric acid ester is less than 0.05 wt % with respect to the total amount of the ink composition, there is a possibility that desired lubricity and the like cannot be obtained; and on the other hand, if the content exceeds 5 wt %, there is a possibility that the temporal stability of the ink is lowered. Furthermore, in order to prevent the stain due to the adhesion of the ink to the writing part 13 and also to prevent resin cracking in the case where the writing part 13 is structured of resin, it is preferable to set the content of the phosphoric acid ester at 1 wt % or less.

In addition, in terms of the viscosity of the ink, a so-called Newtonian ink of which the shear-thinning index (n value) defined by the following expression is approximately 1, and a so-called gel ink of which the shear-thinning index n is defined as <1 can be used as the ink. By using the Newtonian ink, it becomes possible to secure the wettability of the ink at the time of writing; and on the other hand, by using the gel ink, it becomes possible to improve the sharpness of the ink at the time of writing while securing the wettability of the ink.

The shear-thinning index means n in the viscosity expression represented by $S=\alpha D^n$ (wherein $1>n>0$). Incidentally, S represents a shear stress (dyn/cm$^2$), D represents a shear rate ($s^{-1}$), and $\alpha$ represents a non-Newtonian viscosity coefficient.

The Newtonian ink is roughly classified into a type which does not substantially contain a substance having a thickening property and has a relatively low viscosity (less than 5 mPa·s at 25° C.), and a type which substantially contains a substance having a thickening property and imparts a certain viscosity (5 mPa·s or more at 25° C.). It is preferable to use a polyvinyl alcohol and a boric acid compound, as the substance having the thickening property in the latter. By blending the above described substances, it becomes possible to obtain an ink which has adequate flowability, does not cause blurring on the drawn line and is excellent in responsiveness.

Usable polyvinyl alcohols (hereinafter abbreviated simply as "PVA") are represented by a general formula $—[CH_2—CH(OH)]_m—[CH_2—CH(OCOCH_3]_n—$; and a degree of the saponification $\{[m/(m+n)]\times100\}$ is preferably 50 mol % or more and further preferably is 75 mol % or more, from the viewpoint of the temporal stability of the ink and viscosity imparting properties.

In addition, in the PVA having the above described degree of saponification, when the degree of polymerization is high, a range of the fluctuation in viscosity becomes large, which is caused by an additive amount; accordingly it is better that the degree of polymerization (m+n) is low; and the degree is preferably 50 or more, further preferably is 50 to 2000, and particularly preferably is 50 to 1500.

As for PVAs that can be specifically used, PVAs having a preferable degree of saponification and degree of polymerization are selected from among: commercially available A-type Gohsenol series, G-type Gohsenol series and K-type Gohsenol series (product names made by Nippon Synthetic Chemical Industry Co., Ltd.) made by Nippon Synthetic Chemical Industry Co., Ltd.; J Poval series (product name made by JAPAN VAM & POVAL Co., Ltd.) made by JAPAN VAM & POVAL Co., Ltd.; and KURARAY POVAL PVA series (product name made by Kuraray Co., Ltd.) made by Kuraray Co. Ltd. The PVAs having the degrees of saponification and the degrees of polymerization may be used each solely, or two or more types thereof may be simultaneously used.

In addition, for PVAs to be used, modified PVAs, preferably, modified PVAs having the above described range of polymerization degree and degree of saponification can also be used. Examples of the usable modified PVAs include: modified PVAs in which a hydroxyl group or an acetic acid group of PVA is modified into a modified group such as a carboxyl group, a sulfonic acid group, an acetyl group and an ethylene oxide group; or modified PVAs in which PVA has the above described modified groups in its side chain. In addition, a copolymer of PVA/acrylic acid/methyl methacrylate, which is obtained by the copolymerization of acrylic acid and methyl methacrylate with a partially saponified PVA can also be used as the modified PVA in the present invention.

As for modified PVAs that can be specifically used, modified PVAs having a preferable degree of saponification and degree of polymerization are selected from among: commercially available GOHSENEX L series and GOHSENEX WO series (product names made by Nippon Synthetic Chemical Industry Co., Ltd.) made by Nippon Synthetic Chemical Industry Co., Ltd.; anion modified PVAs (A series) (product name made by Japan VAM & POVAL Co., Ltd.) made by Japan VAM & POVAL Co., Ltd.; and Exceval 1713 (product name made by Kuraray Co., Ltd.) made by Kuraray Co., Ltd. In addition, as for the copolymer of PVA/acrylic acid/methyl methacrylate, a preferred copolymer is selected from among POVACOAT (product name, made by Daido Chemical Corporation) made by Daido Chemical Corporation and the like. These modified PVAs may be used each solely, or two or more types thereof may be simultaneously used. The modified PVA does not directly affect the writing performance, but is effective in the temporal stability (viscosity) of the ink. In particular, a carboxyl group-modified type, a sulfonic acid group-modified type and an acetyl group-modified type are excellent in the stability, and accordingly are desirable.

The total contents of such PVA and modified PVA are appropriately adjusted according to a target value of the ink viscosity. When PVA having a high degree of polymerization is used, for instance, the content of PVA is relatively small; and in contrast, when PVA having a low degree of polymerization is used, the content of PVA becomes large.

Examples of the boric acid compounds that can be used include boric acid, alkali metal salts (lithium, sodium, potassium and rubidium) of boric acid, and ammonium salts of boric acid; and include, for instance, boric acid ($H_3BO_3$), di-boron trioxide ($B_2O_3$), sodium metaborate ($NaBO_2$), sodium diborate ($Na_4B_2O_5$), sodium tetraborate ($Na_2B_4O_7$), sodium pentaborate ($NaB_5O_8$), sodium hexaborate ($Na_2B_6O_{10}$), sodium octaborate ($NaB_8O_{13}$), ammonium borate $[(NH_4)_2O—_5B_2O_3]$, and hydrates thereof. These compounds may be used each solely, or two or more types thereof may be simultaneously used. From the viewpoint of the solubility in ink components and versatility, it is preferable to use sodium tetraborate, ammonium borate and di-boric acid trioxide. The total content of these boric acid compounds is appropriately adjusted according to the property and content of PVA so that the ink viscosity becomes the target value.

The gel ink includes a substance which is referred to as a gelling agent or also as a shear-thinning imparting agent. For instance, at least one type which has been selected from the group consisting of synthetic polymers, celluloses and polysaccharides is desirable. Specific examples include arabic gum, tragacanth gum, guar gum, locust bean gum, alginic acid, carrageenan, gelatin, xanthan gum, welan gum, succinoglycan, diyutan gum, dextran, methylcellulose, ethylcellulose, hydroxyethylcellulose, carboxymethylcellulose, oxidized cellulose, starch glycolic acid and salts thereof, propylene glycol alginate ester, polyvinyl pyrrolidone, polyvinyl methyl ether, polyacrylic acid and its salts, a carboxyvinyl polymer, polyethylene oxide, copolymer of vinyl acetate and polyvinyl pyrrolidone, crosslinked acrylic acid polymer and salts thereof, non-crosslinked acrylic acid polymer and salts thereof, and styrene-acrylic acid copolymer and salts thereof. In order to lower the viscosity and lower the shear-thinning index to secure flowability, it is particularly preferable to use oxidized cellulose among the above agents. By having such properties, the ink can develop the high responsiveness to the change in the viscosity, even though changes in a writing angle and a writing load are small and the writing angle and the writing load changes rapidly.

In addition, as for the characteristics of the ink, it is preferable to select such an ink that the contact angle of the ink becomes 70 degrees or smaller after 20 seconds in relation to the outer member of the writing part 13, which will be described below. When the contact angle exceeds 70 degrees, the expandability of the ink with respect to the outer member becomes insufficient, and accordingly the responsiveness at the time when the second writing part works decreases, and the drawn line becomes patchy. Incidentally, the contact angle is measured by dropping ink onto a plate-shaped test piece which is formed of the same material as the outer member, in an environment of 25° C. and 65% RH.

Furthermore, it is preferable to use an ink of which the surface tension is 48 mN/m or less. If the surface tension exceeds 48 mN/m, the expandability of the ink with respect to the outer member becomes insufficient, and accordingly the responsiveness at the time when the second writing part works decreases, which tends to easily cause a phenomenon similar to the above description.

In addition, it is preferable to set the contents of insoluble components such as pigment and resin particles contained in the ink, at 20 wt % or less. If the insoluble component exceeds 20 wt %, the flowability of the ink decreases, and accordingly the expandability of the ink with respect to the outer member tends to become insufficient. Furthermore, the ink which has adhered to the outer member becomes easily dried and solidified, which tends to easily cause the writing failure.

Furthermore, it is preferable that the average particle diameter of the insoluble component contained in the ink is 200 nm or less. If the average particle diameter exceeds 200 nm, the flowability of the ink decreases, and accordingly the expandability of the ink with respect to the outer member tends to become insufficient.

The ink supply part 15 has an approximately tubular collector 17 which has a plurality of fins formed on its circumference, and a tip of the collector 17 is formed so as to have a reduced diameter to form a tip holding part 19. The rear end portion of the collector 17 comes in contact with the front end portion of the ink storage part 11. The tip holding part 19 of the collector 17 is fitted into the inside of a joint 21 from the rear end portion of the joint.

FIGS. 4(*a*) to 4(*c*) are views showing a collector, and FIGS. 4(*a*) to 4(*c*) show views of the collector, which have been viewed from three directions. As is shown in FIGS. 4(*a*) to 4(*c*), the collector 17 has a front side storage part 17*a*, a rear side dummy part 17*b*, and a partition part 17*c* in between the storage part 17*a* and the dummy part 17*b*.

On the circumference of the storage part 17*a*, there are provided an ink guide groove 17*d* which extends along the axis of the storage part 17*a* and has a predetermined width along the circumferential direction, and main part temporary ink storage grooves 17*f*, which are formed in between a plurality of fins 17*e*. Furthermore, in the storage part 17*a*, a hole 17*g* is provided which makes the circumference of the storage part 17*a* communicate with the inner space and extends therebetween.

The ink guide groove 17*d* is formed by the plurality of fins 17*e* being notched into the same shape, which have been arrayed in the axial direction, forms a groove having a predetermined shape, which is recessed from the circumference of the storage part 17*a* when the storage part 17*a* is viewed in the axial direction. The ink guide groove 17*d* communicates with the main part temporary ink storage groove 17*f*. The width of the ink guide groove 17*d* is formed so as to be narrower than the width of the main part temporary ink storage groove 17*f*. Thus, due to the width of the ink guide groove 17*d* being made narrower than the width of the main part temporary ink storage groove 17*f*, the interfacial tension with the ink in the ink guide groove 17*d* becomes stronger than the interfacial tension with the ink in the main part temporary ink storage groove 17*f*. Because of this, while making the ink exist in the ink guide groove 17*d*, the ink guide groove 17*d* can surely make the ink flow into or flow out from the main part temporary ink storage groove 17*f* through itself.

Easiness of the flow of the ink at the time of writing depends on the width of the ink guide groove 17*d* and the distance between the fins 17*e*. Then, in the present embodiment, it is preferable to set the width of the ink guide groove 17*d* at 0.1 to 0.2 mm. As the width of the ink guide groove 17*d* is smaller, the capillary force of the collector 17 becomes easier to act; but on the other hand, when the width becomes 0.1 mm or less, which is too small, the supply of the ink from the collector 17 becomes unstable. The ink resists being discharged (flown out). In addition, the distance between the fins 17*e* is determined according to the width of the ink guide groove 17*d*, and is set to be larger than the width of the ink guide groove 17*d*, in a range of 0.1 to 0.6 mm. If the width between the fins 17*e* becomes smaller than the ink guide groove 17*d*, the storage part 17*a* cannot store the ink therein, and if the width between the fins 17*e* is smaller than 0.1 mm, the supply of the ink becomes unstable.

On the circumference of the dummy part 17*b*, there are provided an ink introduction groove 17*h* which extends in the axial direction, and extended part air grooves 17*j* which are formed each between a plurality of fins 17*i*. The dummy part 17*b* prevents the ink from flowing into the storage part 17*a* of the collector 17, when the cap 5 is opened downward. More specifically, when the cap 5 is opened downward, the space inside the tip, which has been sealed by the cap 5, is decompressed and thereby the ink tries to flow into the storage part 17*a* of the collector 17. By the dummy part 17*b* being provided on the rear side of the collector 17, the ink flows into spaces in between the circumferential fins 17*i* in the dummy part 17*b*, and the ink does not flow into the storage part 17*a* of the collector 17.

In addition, the hole 17*g* of the storage part 17*a* is provided for the purpose of preventing a writing ball 25 from being pushed out from the tip due to an increase in the volume of the ink, when the ink is frozen and the volume of the ink is expanded. More specifically, due to the hole 17*g* being formed to make the inside and the outside of the storage part 17*a* communicate with each other, even if the ink in the storage part 17*a* is frozen and expanded, the ink is discharged to the outside through the hole 17*g*, and accordingly the hole 17*g* can prevent the pressure in the storage part 17*a* from being increased. Incidentally, if the area of the hole 17*g* is too large, the ink is discharged from the storage part 17*a* even when the ink is not frozen, and accordingly it is preferable that the opening area of the hole 17*g* is 0.4 to 1.2 $mm^2$.

In addition, the collector 17 has a rod-like collector core 23 made of polyester fiber. The collector core 23 extends in the axial direction, the rear end portion is slidably arranged inside the ink storage part 11, and the front end portion extends beyond the joint 21. The collector core 23 is arranged so as to form a gap of 0.02 to 0.2 mm between the internal perimeter surface of the collector 17 and itself. Due to the gap of 0.02 to 0.2 mm being provided between the collector 17 and the collector core 23, it becomes possible to prevent a large amount of air from entering the gap at the time of writing, while securing slidability between the collector 17 and the collector core 23. In addition, the rear end of the collector core 23 extends to project beyond the rear end of the collector 17. In order to achieve both ink supply stability and ease of suction, it is preferable that the collector core 23 is formed from a material having a porosity of 30 to 60%, and is most preferable to have the porosity of 45%.

The joint 21 is a member for connecting the writing part 13 with the ink supply part 15. Incidentally, the structure of the joint 21 will be described below.

The writing part 13 has the writing ball 25, a holder 27 in which the writing ball 25 is received in the front end portion thereof, a rod-like central core 29 which extends in the holder 27, and an outer member 31 which covers the circumference of the holder 27.

FIGS. 5(*a*) and 5(*b*) are enlarged views of the vicinity of the front end portion of the ballpoint pen; and more specifically, FIG. 5(*a*) is a cross-sectional view of a main part in the vicinity of the front end portion of the ballpoint pen, and FIG. 5(*b*) is a side view of the vicinity of the front end portion of the ballpoint pen.

As is shown in FIGS. 5(*a*) and 5(*b*), the holder 27 has a cylindrical shape with both ends in the axial direction opened, of which the front end has an approximately conical shape and a tapered shape that tapers toward the front, and this tapered portion forms a caulked part (narrowed part) 33 for holding the writing ball 25. The caulked part 33 has such a size and shape that the front opening of the holder 27 becomes smaller than the diameter of the writing ball 25, and that the writing ball 25 can freely rotate in the caulked part 33. In addition, a part of the writing ball 25 which is held in the caulked part 33 is structured so as to be exposed to the outside from an opening in front of the holder 27, and to be viewed from the outside. The holder 27 can be formed by processing a pipe material made of metal such as stainless steel or a resin such as polyacetal.

In addition, it is preferable that the holder 27 has a shape which tapers toward the front, in the vicinity of the front end thereof. More specifically, it is preferable that the circumferential surface in the vicinity of the front end of the holder 27 is designed to be an inclined surface having a taper angle of approximately 10 to 20 degrees with respect to the axis of the ballpoint pen 1, over a distance of approximately 0.5 mm or longer. Due to the inclined surface being formed at the front end of the holder 27, it becomes possible to increase the thickness of the outer member 31 which is arranged outside the holder 27, without increasing the diameter of the front end of the ballpoint pen 1, and to enhance the strength of the outer member 31. If the length in the axial direction of the inclined surface is short, it becomes difficult to position the holder 27 when the holder 27 is arranged inside the outer member 31, and accordingly it is preferable that the length in the axial direction of the inclined surface is 0.5 mm or longer. In addition, it is preferable for the external surface of the caulked part 33 of the holder 27, in other words, for the surface further forward than the inclined surface of the holder 27 to have an angle of 35 to 50 degrees or an R shape with respect to the axis of the ballpoint pen 1. Due to the external surface of the caulked part 33 being designed to have the inclination angle of 35 to 50 degrees or to have the R shape, the distance between the outer member and the ball becomes short, thereby the ballpoint pen can prevent the shortage of the ink, and accordingly can maintain "ink continuity at the time of writing". In addition, it is preferable that the amount of the projection of the holder 27 from the outer member 31 is set at 10 to 100% of the diameter of the writing ball 25, in consideration of the ease of contact of the outer member 31 with the paper surface.

The central core 29 is arranged in the inside of the holder 27 and is formed of polyester fiber similarly to the collector core 23; and its rear end is fitted into the front end of the collector core 23, and at the same time, the front end thereof reaches the rear side of the writing ball 25. In addition, in order to secure the ink supply stability, the central core 29 is preferably formed from a material having a porosity of 30 to 80%, and most preferably is formed of a material having a porosity of 50 to 70%. Thereby, the ink which has been supplied from the collector core 23 is supplied to the rear side of the writing ball 25 through the central core 29. The central core 29 is held by the joint 21 in such a state that the part of approximately ⅔ from the rear end is fitted into the front end portion of the joint 21.

Incidentally, the collector core 23 and the central core 29 are formed of polyester fiber having a porosity and a surface shape which have been appropriately selected in accordance with the properties such as the viscosity of the ink to be used. In addition, it is possible to use a plastic rod-like core which has been extrusion molded or a sinter processed rod-like core, instead of a polyester fiber, for the central core 29.

FIGS. 6(*a*) to 6(*c*) are views showing a joint; and specifically, FIGS. 6(*a*) to 6(*c*) show a perspective view, a side view and a cross-sectional view of the joint. The joint 21 shown in FIGS. 6(*a*) to 6(*c*) has a cylindrical tubular portion 35, an anchor portion 37 which is arranged outside the tubular portion 35, and a holding portion 39 which holds the tubular portion 35 on a base of the anchor portion 37.

The tubular portion 35 has such an internal shape as to be capable of fixing the collector core 23 and the central core 29 in its inside. Specifically, the internal diameter of the tubular portion 35 is sized so that the tubular portion receives and fixes the comparatively thick collector core 23 on its rear side and receives and fixes the comparatively thin central core 29 on the front side of the portion at which the collector core 23 is fixed. In addition, the diameter of the tubular portion 35 in a further front side than the fixed portion of the central core 29 is slightly enlarged, and the holder 27 is fitted in between the central core 29 and the tubular portion 35.

The anchor portion 37 has a ring shape of which the internal diameter is larger than an external diameter of the tubular portion 35, and is arranged on a further rear side than the middle in the longitudinal direction of the tubular portion 35. More specifically, the internal diameter of the anchor portion 37 is larger than the external diameter of the tubular portion 35, a space is formed between the anchor portion 37 and the tubular portion 35, and the tip holding part 19 is inserted into the space. When the tip holding part 19 is inserted into the space, the circumference of the tip holding part 19 is fitted into the inner circumference of the anchor portion 37, and the anchor portion 37 is fixed to the tip holding part 19. Incidentally, a space of a cylindrical shape is formed in the tip holding part 19, and the internal diameter of the space of the cylindrical shape is larger than the external diameter of the tubular portion 35, and is designed so that when the tip holding part 19 and the tubular portion 35 are arranged coaxially with each other, the tubular portion 35 and the tip holding part 19 do not come into contact with each other.

The holding portion 39 has a conical tubular shape which extends so as to taper from the circumference of the anchor portion 37 to the circumference of the tubular portion 35 toward the front side. In addition, the holding portion 39 is arranged between the anchor portion 37 which is fixed to the tip holding part 19 and the tubular portion 35 which is not fixed to the other members and suspends the tubular portion 35 with respect to the anchor portion 37; and thereby it becomes possible to suspend the tubular portion 35 and the writing ball 25, the holder 27, the central core 29 and the collector core 23 in the writing part 13, which are fixed to the tubular portion 35, so as to be movable in the axial direction with respect to the outer member 31 that is fixed to the front side shaft tube 7. Thereby, the pressure applied to the writing ball 25 can be absorbed at the time of writing.

The tubular portion 35 and the anchor portion 37 which constitute the joint 21 are formed from, for instance, a thermoplastic resin. In addition, the holding portion 39 is formed from, for instance, a thermoplastic elastomer. Specific examples thereof include styrene-based elastomers such as SBS, SEBS and SEPS, olefin-based elastomers, urethane-based elastomers, and polyester-based elastomers. Among the elastomers, elastomers having a durometer A hardness of 20 to 60 in accordance with ISO 7619 have a good balance between the writing pressure and a cushioning response. Furthermore, the cushioning properties of the joint 21 can be adjusted by adjusting the strength of the holding portion 39. In addition, the thermoplastic elastomer sensitively expands and contracts in response to the change of the load until just before the inflection point at which elastic deformation starts, and accordingly, it is possible to form a joint 21 which highly sensitively expands and contracts in response to the load at the time of writing and is excellent in cushioning properties, by adjusting, for instance, the thickness, the composition and the like of the holding portion 39 and setting the inflection point of the load with respect to the displacement amount at approximately 1 N. In addition, a certain degree of adhesion becomes necessary between the tubular portion 35 and the holding portion 39, in order to make both of the portions not come off from each other at the time of cushioning. In order to achieve this adhesion, it is preferable to form the tubular portion 35 and the holding portion 39 from the same type of resin material; and as for selectable combinations between the materials, there are a combination of AS (styrene-based resin) and SEBS (styrene-based elastomer), a combination of polypropylene (polyolefin-based resin) and EPDM (polyolefin-based elastomer), and a combination of PBT (polyester-based resin) and a polyester-based elastomer.

Among the combinations, the holding portion 39 preferably has a durometer A hardness in accordance with ISO 7619 of 20 to 60 degrees, and most preferably of 30 to 50 degrees. Due to the durometer A hardness of the holding portion 39 being set in this range, the joint 21 can properly work even for a low writing pressure and absorb the pressure applied to the writing ball 25.

In addition, it is preferable to set a cushioning force of the whole ballpoint pen in a range of 0.1 to 10 N, and is more preferable to set the force in a range of 0.1 to 5 N, by using the joint 21. This is because if the cushioning force is set too low, it cannot absorb the force applied to the outer member 31 at the time of writing, and the outer member 31 is damaged. On the other hand, if the cushioning force is set too high, it becomes impossible for the user to write with bringing the outer member 31 into contact with the paper surface, at the time of writing.

FIGS. 7(*a*) to 7(*c*) are views showing the outer member; and specifically, FIGS. 7(*a*) to 7(*c*) show a perspective view, a side view and a cross-sectional view of the joint. The outer member 31 is a conical tube which is made from a synthetic resin and is formed in an approximately conical shape, and has such a tapered shape as to taper toward the front. It is preferable that the outer member 31 is formed from a synthetic resin such as polyacetal or polybutylene terephthalate having a certain strength so as not to hinder the condition of the pen and writing feeling in writing with pushing. The outer member 31 can be formed from a general synthetic resin. Specific examples of the synthetic resins include polyethylene, polypropylene, polyvinyl chloride, polyvinylidene chloride, polystyrene, polyvinyl acetate, polyurethane, fluororesin, ABS resin, AS resin, PMMA resin, polyamide, polyacetal, polycarbonate, modified polyphenylene ether, polyethylene terephthalate, polybutylene terephthalate, polyphenylene sulfide and polyether ether ketone. It is preferable that the outer member 31 is formed from polyacetal and polybutylene terephthalate among the above synthetic resins, which do not hinder the condition of the pen, in particular, writing feeling in the writing with pushing, in which friction in particular strongly works, and which show little wear due to the writing and have high durability. By giving a certain strength to the outer member 31, it becomes possible to improve the durability of the outer member 31. In addition, it is preferable to control the surface of the outer member 31 to become a smooth surface, which can thereby reduce the frictional resistance with the paper surface at the time of writing and can improve the writing feeling. The coefficient of friction between the paper surface and the outer member 31 at the time of writing is preferably 0.5 or less by a Heidon value, and is more preferably 0.25 or less. The Heidon value is measured with the use of a surface property measuring instrument (HEIDON-14D made by Shinto Scientific Co., Ltd.). As for the measurement conditions, on conditions of a load of 100 g, a writing angle of 60 degrees and a writing speed of 6.25 cm/sec, the outer member 31 is linearly operated in an acute angle direction by 10 cm with respect to a writing paper which conforms to the old JIS P3201 (high grade paper of which the sheet has been made from a raw material of 100% chemical pulp, having basis weight range of 40 to 157 g/m$^2$, and having whiteness degree of 75.0% or more).

In addition, the outer member 31 has a rear insertion hole 41 which is formed in the rear side, and a front insertion hole 43 which communicates with the tip side from the rear insertion hole 41 and has a diameter smaller than that of the rear insertion hole 41. A front end of the joint 21 is inserted into the rear insertion hole 41, and the holder 27 which is fixed to the front end of the joint 21 projects from the front insertion hole 43. At the time of assembly, the outer member 31 is fixed to the front end of the front side shaft tube 7 in such a state that the holder 27 is inserted into the front insertion hole 43 and the front end of the joint 21 is inserted into the rear insertion hole 41. Thereby, the writing ball 25, the holder 27 and the central core 29 in the writing part 13 are held by the joint 21 so as to be movable in the axial direction in the outer member 31. It is preferable to set the thickness of the tip of the outer member 31, particularly in the vicinity of the front insertion hole 43, at 0.02 to 0.2 mm. Due to the thickness of the tip of the outer member 31 being set in this range, it becomes possible to secure the dischargeability of the ink at the time of writing while keeping durability.

In addition, the outer member 31 has a ring-shaped step 45 in a middle portion in the axial direction thereof; and the further rear side than the step 45 has an external diameter smaller than the internal diameter of the tubular space at the tip of the front side shaft tube 7, and the rear side of the outer member 31 is structured so as to be capable of being fitted into the front side shaft tube 7.

FIGS. 8(*a*) to 9(*b*) are views showing a state in which the ballpoint pen is used.

As is shown in FIG. 8(*a*) and FIG. 8(*b*), when the writing angle, specifically, the angle of the axis of the ballpoint pen 1 with respect to the paper surface W is, for instance, 80 degrees, only the writing ball 25 comes in contact with the paper surface W, as shown in FIG. 8(*b*) in particular. In this state, when a writing weight of approximately 1 g is applied to the ballpoint pen 1, the ink in the ink storage part 11 flows into the writing part 13 through the collector 17 and the collector core 23 in the ink supply part 15. Then, the ink which has reached the writing part 13 reaches the rear side of the writing ball 25 through the central core 29. When the user moves the ballpoint pen 1 on the paper surface W, the writing ball 25 rotates along the movement direction in the caulked part 33. When the writing ball 25 rotates, the ink which has reached the rear side of the writing ball 25 exits from the inside of the holder 27 along the surface of the writing ball 25, moves to the paper surface W, and adheres to the paper surface W. Here, when the writing angle is large and the writing weight is small, the amount of the ink discharged from the holder is small, and accordingly the ballpoint pen 1 can draw a comparatively thin line. Thus, in the ballpoint pen 1, the writing ball 25 works as a "first writing part" of the present invention.

In addition, as is shown in FIG. 9(*a*) and FIG. 9(*b*), when the writing angle is, for instance, 50 degrees, the writing ball 25 and the outer member 31 come in contact with the paper surface W. In this state, when a writing weight of approximately 200 g is applied to the ballpoint pen 1, a space of a closed cross section is formed by the writing ball 25, the front end portion of the outer member 31 and the paper surface W when viewed from the side, and this space becomes an ink puddle. Thereby, the user can draw a comparatively thick line of which the width L1 corresponds to a distance between the contact point P1 between the writing ball 25 and the paper surface W and a contact point P2 between the outer member 31 and the paper surface W. Thus, in the ballpoint pen 1, the writing ball 25 and the outer member 31 work as a "second writing part" of the present invention.

The thickness of the line to be drawn corresponds to the distance between the contact point between the writing ball 25 and the paper surface W and the contact point between the outer member 31 and the paper surface W, and accordingly the thickness of the line mainly depends on the diameter of the writing ball 25, a position at which the holder 27 holds the writing ball 25, an angle of the inclined surface of the outer member 31, and the shape of the front end of the outer member 31 including the position of the front side end portion of the outer member 31; but if it is intended to draw an extremely thick line by designing the distance between the contact point between the writing ball 25 and the paper surface W and the contact point between the outer member 31 and the paper surface W too large, there is the case where the ink becomes insufficient and the continuity of the ink is lowered. Accordingly, it is preferable to determine the shape of the outer member 31 so that the distance between the contact point between the writing ball 25 and the paper surface W and the contact point between the outer member 31 and the paper surface W is 100% or less of the diameter of the writing ball 25, and is preferably 50% or less thereof.

Hereinafter, the main functions/effects of the present invention will be summarized.

In the present embodiment, by adopting the outer member 31, the ballpoint pen can adjust the amount of ink to be discharged, according to the writing angle and the writing weight. More specifically, by increasing the writing angle and decreasing the writing weight, the user can reduce the amount of ink to be discharged and draw a relatively thin line only by the writing ball 25 working as the first writing part. On the other hand, by decreasing the writing angle and increasing the writing weight, the user can increase the amount of ink to be discharged (i.e., increase the writing ink flow rate) and draw a relatively thick line by the writing ball 25 and the outer member 31 which work as the second writing part. Furthermore, by adopting the outer member 31, the ballpoint pen can resolve the shortage of ink in the case where the writing angle is small. In addition, in a general ballpoint pen, at the time of so-called "writing with pushing" of drawing a line while directing and moving the ballpoint pen 1 toward the front side, which has been tilted at a predetermined writing angle, the continuity of the ink tends to decrease particularly due to the shortage of the ink, but the ballpoint pen 1 according to the present embodiment can increase the amount of the ink to be discharged by imparting the writing angle to the ballpoint pen 1, and accordingly can prevent "discontinuity of ink at the time of writing" at the time of so-called "writing with pushing". In addition, by adopting the outer member 31, the ballpoint pen can prevent the caulked part 33 of the holder 27 from coming in contact with the paper surface and the friction resistance from increasing, at the time of so-called "writing with pushing" when the writing angle is small.

In addition, in the present embodiment, by adopting the joint 21 having high cushioning properties, the ballpoint pen can discharge a sufficient amount of ink even when the writing weight is light. For example, a ratio of a writing flow rate when a line is drawn with a writing angle of 60 degrees and a writing weight of 200 g, to a writing flow rate when the line is drawn with a writing angle of 60 degrees and a writing weight of 40 g, is 1.2 or larger. As another example, a ratio of a width of a line which is drawn with a writing angle of 60 degrees and a writing weight of 200 g, to a width of the line which is drawn with the writing angle of 60 degrees and a writing weight of 40 g, is 1.3 or larger. Thereby, even in the case where a user whose writing weight is light has used the ballpoint pen, the ballpoint pen can avoid "discontinuity of ink at the time of writing" due to the shortage of the ink. This function/effect is observed particularly at the time of writing with pushing during which "discontinuity of ink at the time of writing" tends to easily occur.

In addition, according to the present embodiment, the amount of the ink which flows out can be accurately controlled by appropriately selecting the components of the ink and adjusting the surface tension and the flowability of the ink, and further it can properly prevent the outer member 31 of the writing part 13 from being stained by the ink. Furthermore, the writing starting properties of the ballpoint pen can be improved by adjusting the components of the ink.

Modified examples of the embodiment of the present invention will be described in detail below.

Figure 10:
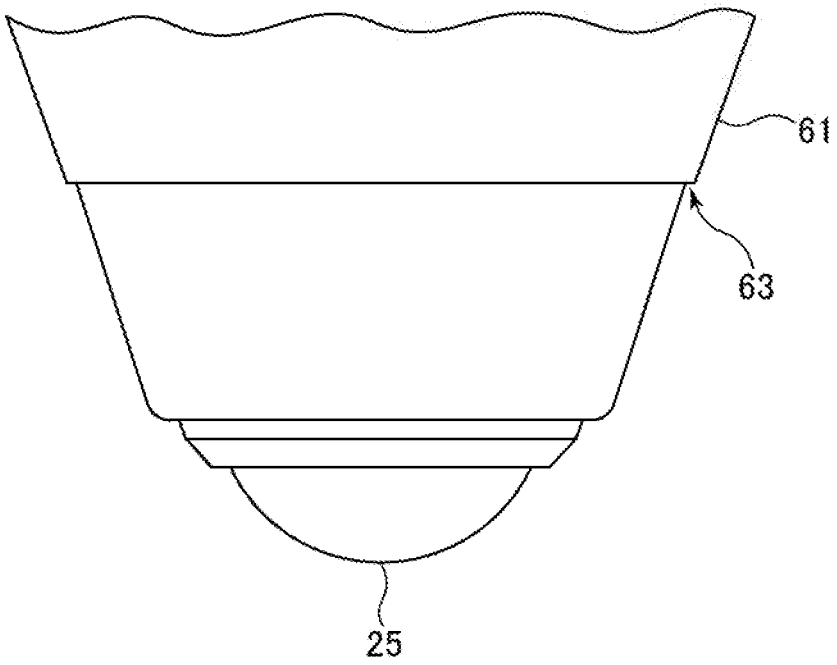
FIG. 10 is a side view showing a modified example of the outer member of the ballpoint pen according to the embodiment of the present invention.

FIG. 10 is a side view showing a modified example of the outer member. As shown in FIG. 10, an outer member 61 according to the modified example has a step 63 which extends circumferentially, on the outer circumference. The step 63 has such a shape that the external diameter of the outer member 61 is reduced toward the forward direction. In addition, by providing the step 63 on the outer member 61, it can prevent the ink from traveling along the surface of the outer member 61 and flowing to a further rear side than the step 63.

FIGS. 11(*a*) to 11(*c*) show further modified examples of the outer member. In the example shown in FIG. 1 (*a*), a ring-shaped projection 65 is provided instead of the above described step 63. Also, by providing the projection 65 on the surface of the outer member 61, it can prevent the ink from traveling along the surface of the outer member 61 and flowing to a further rear side than the projection 65. In addition, in the example shown in FIG. 11(*b*), a ring-shaped groove 67 is provided instead of the above described step 63. Also, by providing the groove 67 on the surface of the outer member 61, it can prevent the ink from flowing to a further rear side than the groove 67.

Furthermore, in an example shown in FIG. 11(*c*), a surface roughness of a surface in a front side of the outer member 61 is controlled so as to be different from a surface roughness in a rear side of the outer member 61. Specifically, a smooth surface 69 in the front side of the outer member 61 is formed so as to be a relatively smooth or slick surface, and a rough surface 71 in the rear side of the outer member 61 is formed so as to be a relatively rough surface. Thus, by changing surface roughness on the outer member 61, it can prevent the ink from flowing from the smooth surface 69 toward the rough surface 71.

Examples according to the present invention are described in detail below.

In the example, the ballpoint pens (pen body 1) shown in FIGS. 1(*a*) to 1(*c*) were filled with Ink A and Ink B in Table 1, respectively, and ballpoint pens (pen body 2) shown in FIGS. 13(*a*) and 13(*b*) were filled with Ink C and Ink D in Table 1, respectively. Then, cursive script "U" was written freehand on a sheet of paper for writing test, and a blur in the thick line portion, a longitudinal crack in the thick line portion, and the continuity when the thin line portion changes to the thick line portion were respectively visually evaluated.

TABLE 1

| | | Ink A | Ink B | Ink C | Ink D |
|---|---|---|---|---|---|
| Blended composition | Viscosity modifier 1: modified polyvinyl alcohol A *1 | 0.8 | | | |
| | Viscosity modifier 2: oxidized cellulose | | | 0.28 | |
| | Viscosity modifier 3: xanthan gum *2 | | | | 0.36 |
| | Viscosity modifier B: ammonium borate | 0.3 | | | |
| | Coloring material: carbon black *3 | 8.0 | 8.0 | 8.0 | 8.0 |
| | Dispersing agent *4 | 6.0 | 6.0 | 6.0 | 6.0 |
| | Lubricant: phosphoric acid ester *5 | 0.2 | 0.2 | 0.5 | 0.5 |
| | Rust-preventive agent: benzotriazole | 0.3 | 0.3 | 0.3 | 0.3 |
| | Antiseptic agent *6 | 0.3 | 0.3 | 0.3 | 0.3 |
| | pH adjustor: triethanolamine | 1.6 | 1.6 | 1.6 | 1.6 |
| | Solvent: propylene glycol | 12.0 | 12.0 | 12.0 | 12.0 |
| | Water: (ion-exchanged water) | Balance | Balance | Balance | Balance |
| cosi | 383 $sec^{-1}$ | 4.0 | 3.0 | 23.0 | 55.0 |
| | Shear-thinning index | 0.90 | 1.00 | 0.35 | 0.30 |

(Note)
*1: GOHSENX L series L-3266 (made by The Nippon Synthetic Chemical Industry Co., Ltd.)
*2: Kelzan AR (made by Sansho Co., Ltd.)
*3: Carbon black MA-100 (made by Mitsubishi Chemical Corporation)
*4: JONCRYL 61J (made by BASF Japan)
*5: Phosphoric acid ester RS-610 (made by Toho Chemical Industry Co., Ltd.)
*6: Bestside 600 (made by Nippon Soda Co., Ltd.)

The results of the above described tests are shown in Table 2.

TABLE 2

| | Example 1 | Example 2 | Example 3 | Example 4 |
|---|---|---|---|---|
| Ink | A | B | C | D |
| Pen body | 1 | 1 | 2 | 2 |
| Blur in thick line portion | ○ | Δ | ○ | ○ |
| Line crack in thick line portion | ○ | ○ | ○ | Δ |
| Continuity from thin line portion to thick line portion | ○ | ○ | ○ | Δ |

As for the evaluation of the blur in the thick line portion in Table 2, "O" means that the blur was not observed, and "Δ" means that a slight blur was observed. In addition, as for the evaluation of the longitudinal crack in the thick line portion, "O" means that the concentration of the drawn line was uniform, and "Δ" means that the concentration in the middle part of the drawn line was slightly thin. Furthermore, as for the evaluation of the continuity when the thin line portion changes to the thick line portion, "O" means that the drawn line continuously changed, and "Δ" means that a defect was observed in a part of the drawn line.

Further modified examples according to the present invention are be described in detail below.

FIGS. 12(*a*) and 12(*b*) are a side view and a cross-sectional view of a ballpoint pen according to a modified example. As is shown in FIGS. 12(*a*) and 12(*b*), the ballpoint pen according to the modified example has a central cotton 101 in which ink is impregnated, instead of a collector. The rear end of the hollow central core 103 is inserted into the central cotton 101, and the front end of the central core 103 extends to the writing ball 25. The central core 103 is held so as to be movable in the axial direction, by a joint 107 which has a similar structure to that of the joint 21. Incidentally, structures of other parts are the same as structures which have been described in detail with reference to FIGS. 1(*a*) to 1(*c*) and so on.

It is preferable that the central cotton 101 is formed from a material which has a porosity of 85 to 90%, in order to secure the dischargeability of the ink. In addition, the central core 103 is inserted into the central cotton 101 with a depth of 5 mm or deeper. By setting an amount of insertion of the central core 103 at 5 mm or more, the dischargeability of the ink can be secured.

FIGS. 13(*a*) and 13(*b*) are a side view and a cross-sectional view of a ballpoint pen according to a further modified example of the modified example of FIGS. 12(*a*) and 12(*b*). In the example shown in FIGS. 13(*a*) and 13(*b*), a space is provided in the rear side of the inside of the external tube 107 of the ballpoint pen, and the central cotton 101' is arranged so as to be movable in the axial direction in the external tube 107. Thereby, the central cotton 101' moves in the axial direction together with the central core 103', when the central core 103' moves in the axial direction by the operation of the joint 105', at the time of writing. Such structure can prevent the amount of insertion of the central core 103' into the central cotton 101' from being changed due to the movement of the central core 103'.

Figure 14:
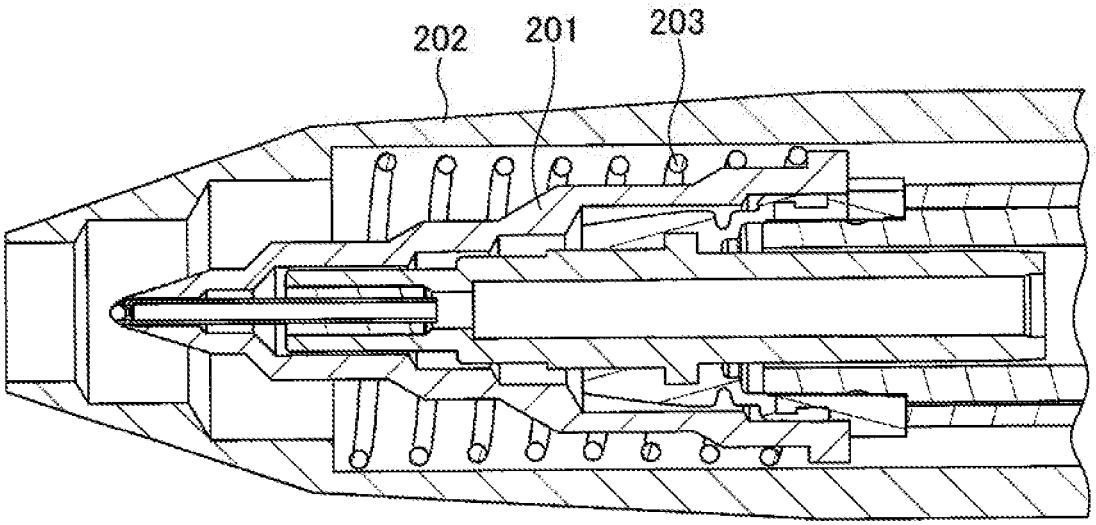
FIG. 14 is a cross-sectional view of a ballpoint pen according to a further modified example.
Figure 15:
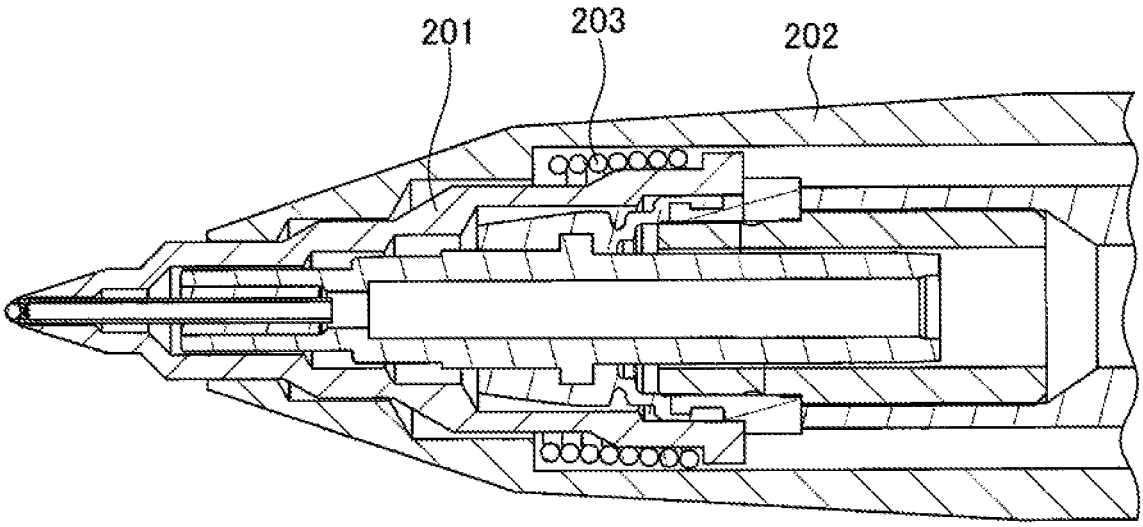
FIG. 15 is a cross-sectional view of the ballpoint pen according to the further modified example.

FIG. 14 and FIG. 15 are cross-sectional views of a ballpoint pen according to a further modified example. In this modified example, the outer member is applied to a click-type ballpoint pen. In the case of the click-type ballpoint pen, the outer member 201 is received in the external tube 202 of the ballpoint pen together with the whole pen tip, when the pen tip is accommodated (FIG. 14). Then, the pen tip is exposed by an operation of pushing the button end portion on the rear side of the ballpoint pen (FIG. 15). In addition, when the outer member is applied to the click-type ballpoint pen, if a clicking load at the time of an operation of exposing the pen tip is too large, there is a possibility that the outer member 201 is damaged. Accordingly, it is preferable that the clicking load at the time of the operation of exposing the pen tip is set to a range of 3 to 4 N, by the adjustment of the strength of the spring 203 or the like.

FIGS. 16(*b*), 17(*a*) and 17(*b*) are cross-sectional views of a ballpoint pen according to a further modified example. In this modified example, the outer member is applied to a multifunctional ballpoint pen. The multifunctional ballpoint pen receives at least two pen tips 301 and 302 in the external tube 303, and the pen tips 301 and 302 are exposed through the common opening from the front end of the pen according to the principle of the click-type ballpoint pen. In this case, the outer member 304 is fixed to the front end of the external tube. Thereby, also in the multifunctional ballpoint pen provided with the plurality of pen tips 301 and 302, the ballpoint pen can draw lines of various thicknesses with one outer member 304.

FIGS. 18(*a*) and 18(*b*) are cross-sectional views of a ballpoint pen according to a further modified example. In the ballpoint pen according to the modified example, the contour of the outer member 401 is different from that of the above described outer member. The outer member 401 is different from the above described outer member, and does not have a conical shape, but such a shape that the tip of the outer member 401 extends in both directions from both sides of the writing ball 403. Then, at the time of writing, the ink which has been discharged from the writing ball 403 spreads toward both sides of the writing ball 403 along the tip of the outer member 401, and accordingly the ballpoint pen can draw such a line as to be drawn by a line marker.

FIGS. 19(*a*) and 19(*b*) are a cross-sectional view and a front view of a ballpoint pen according to a further modified example. An outer member 501 of the ballpoint pen according to the modified example has a trigonal pyramidal shape. When the front face of the outer member 501 is viewed from the front side of the pen, all sides of a triangle which is viewed when the outer member 501 has been projected have different lengths. Then, due to such a structure, by drawing a line while bringing any side into contact with the paper surface at the time of writing, the user can draw a line having a thickness corresponding to the selected side. In other words, the modified example shown in FIGS. 19(*a*) and 19(*b*) is an example of which the choices of thicknesses of the line have increased as compared to the modified example according to FIGS. 18(*a*) and 18(*b*).

FIGS. 20(*a*) to 20(*c*) are a cross-sectional view, a front view and a perspective view of a ballpoint pen according to a further modified example. An outer member 601 of the ballpoint pen according to the modified example has such a shape as to expose a half of the central core 603, at the pen tip. Thereby, the central core 603 can be bent at the time of writing, and the user can obtain such a writing feeling as to use a fountain pen, from the ballpoint pen.

FIGS. 21(*a*) and 21(*b*) are cross-sectional views of a ballpoint pen according to a further modified example. The ballpoint pen according to the modified example is structured so as to be capable of adjusting the relative position of the outer member 701 with respect to the external tube 703. Specifically, the outer member 701 is threadedly engaged with the external tube 703 and can change a state shown in FIG. 22(*a*) to a state shown in FIG. 22(*b*) in which the outer member 701 further projects to the front side, by rotating the outer member 701 with respect to the external tube 703. In addition, a user can adjust the cushioning force due to the joint 707, by adjusting the relative position of the outer member 701 with respect to the joint 707. The method of moving the outer member 701 back and forth is not limited to the above method, and there is such a method, for instance, as to fit the outer member 701 into the external tube 703 in a slidable state, and to be capable of moving the outer member 701 back and forth with respect to the external tube 703. The outer member 701 may be structured so as to be capable of thereby adjusting the relative position with respect to the external tube 703.

REFERENCE SIGNS LIST

1 ballpoint pen
25 writing ball
31 outer member

The invention claimed is:

1. A ballpoint pen comprising:

a first writing part having a writing ball on a pen tip side;

a second writing part on the pen tip side, wherein the first and second writing parts are capable of drawing a thicker line than a line drawn by only the first writing part based on a writing weight that is a weight applied to the pen when the pen contacts a surface and a writing angle that is an angle of an axis along a longitudinal center line of the pen with respect to the surface;

a tubular portion extending toward the first writing part;

an anchor portion on a tip holding part of the pen, the tubular portion being movable relative to the anchor portion in an axial direction of the pen; and a holding portion having a conical tubular shape that extends so as to taper from a circumference of the anchor portion to the tubular portion;

wherein only the first writing part contacts the surface when a first writing weight of non-zero is applied to the pen and the writing angle is 90 degrees when the pen contacts the surface, and wherein the first and the second writing parts contact the surface when a second writing weight that is higher than the first writing weight is applied to the pen when the pen is on the surface and the pen is tilted where the writing angle is less than the 90 degrees and greater than 40 degrees.

2. The ballpoint pen according to claim 1, wherein a ratio of a writing flow rate when a line is drawn with the writing angle being 60 degrees and the writing weight being 200 g, to a writing flow rate when a second line is drawn with the writing angle being 60 degrees and the writing weight being 40 g, is 1.2 or larger.

3. The ballpoint pen according to claim 2, wherein a ratio of a width of the line which is drawn with the writing angle being 60 degrees and the writing weight being 200 g, to a width of the second line which is drawn with the writing angle being 60 degrees and the writing weight being 40 g, is 1.3 or larger.

4. The ballpoint pen according to claim 1, wherein a ratio of a width of a line which is drawn with the writing angle being 60 degrees and the writing weight being 200 g, to a width of a second line which is drawn with the writing angle being 60 degrees and the writing weight being 40 g, is 1.3 or larger.

5. The ballpoint pen according to claim 1, wherein a space is formed between the anchor portion and the tubular portion so that the tip holding part is inserted into the space.

6. The ballpoint pen according to claim 5, wherein the conical tubular shape tapers from the circumference of the anchor portion to a circumference of the tubular portion toward the pen tip side.

7. The ballpoint pen according to claim 1, wherein the conical tubular shape tapers from the circumference of the anchor portion to a circumference of the tubular portion toward the pen tip side.

* * * * *